US008041063B2

(12) United States Patent
Iwano et al.

(10) Patent No.: US 8,041,063 B2
(45) Date of Patent: Oct. 18, 2011

(54) HEARING AID AND HEARING AID SYSTEM

(75) Inventors: Kenji Iwano, Kanagawa (JP); Atsunobu Murase, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/059,875

(22) PCT Filed: Aug. 18, 2009

(86) PCT No.: PCT/JP2009/003931

§ 371 (c)(1),
(2), (4) Date: Feb. 18, 2011

(87) PCT Pub. No.: WO2010/021125

PCT Pub. Date: Feb. 25, 2010

(65) Prior Publication Data

US 2011/0142273 A1 Jun. 16, 2011

(30) Foreign Application Priority Data

Aug. 20, 2008 (JP) ..... 2008-212050

(51) Int. Cl.
*H04R 25/00* (2006.01)

(52) U.S. Cl. ..... 381/321; 381/312; 381/316

(58) Field of Classification Search ..... 381/312, 381/316–318, 320–321
See application file for complete search history.

(56) References Cited

U.S. PATENT DOCUMENTS

| | | | | |
|---|---|---|---|---|
| 6,910,013 | B2 * | 6/2005 | Allegro et al. | 381/312 |
| 7,650,005 | B2 * | 1/2010 | Chalupper | 381/320 |

FOREIGN PATENT DOCUMENTS

| | | |
|---|---|---|
| CA | 2 422 449 | 3/2003 |
| DE | 2846492 | 5/1979 |
| JP | 54-109303 | 8/1979 |
| JP | 1-149508 | 6/1989 |
| JP | 5-130695 | 5/1993 |
| JP | 6-276599 | 9/1994 |
| JP | 9-18998 | 1/1997 |
| JP | 3482465 | 10/2003 |
| JP | 2004-501738 | 1/2004 |
| JP | 2004-522333 | 7/2004 |
| JP | 2005-203981 | 7/2005 |
| JP | 2006-229866 | 8/2006 |
| WO | 02/05590 | 1/2002 |
| WO | 2007/052185 | 5/2007 |

OTHER PUBLICATIONS

International Search Report of PCT Application No. PCT/JP2009/003931, dated Nov. 2, 2009.

* cited by examiner

*Primary Examiner* — Suhan Ni
(74) *Attorney, Agent, or Firm* — Panasonic Patent Center; Dhiren Odedra; Kerry Culpepper

(57) ABSTRACT

A hearing aid that can reflect setting change of the hearing aid responsive to a sound environment by the user as intended, prevent the user from feeling inconvenience or displeasure caused by changing setting of the hearing aid, and enable the user to easily change the setting is provided.

A hearing aid of the invention includes a microphone 101 configured to generate an input signal from an input sound, a signal processing unit 120 configured to process the input signal and generating an output signal, and a receiver 103 configured to play an output sound from the output signal. The signal processing unit 120 determines a time response of the input signal based on a contact sound generated when the hearing aid is contacted in a predetermined time period, and changes setting of the hearing aid based on the time response.

11 Claims, 17 Drawing Sheets

(a)

(b)

(c)

(a)

(b)

(c)

(a)

(b)

(c)

(a)

(b)

(c)

(a)

(b)

(c)

(a)

(b)

(c)

HEARING AID AND HEARING AID SYSTEM

TECHNICAL FIELD

This invention relates to a hearing aid and a hearing aid system and in particular to a hearing aid and a hearing aid system capable of simplifying setting (volume and operation mode) change of the hearing aid.

BACKGROUND ART

There is a need for a hearing aid to improve the audibility of sound, etc., in response to distinguishing between sound and non-sound and the degree of surrounding noise, undesired sound, or reverberation and play high-clarity sound independently of the sound environment. To meet the need, there is a hearing aid including a hearing aid main body to which a volume change button and an operation mode change button are added for enabling a person wearing the hearing aid to consciously change setting in response to the use scene and the sound environment (for example, see Patent Document 1).

On the other hand, as a technique for the hearing aid user to unconsciously change setting in response to the sound environment, there is a signal processing technique of classifying various acoustic signals previously (learning phase) and automatically changing setting of amplification, etc., of an input acoustic signal in response to the sound environment using the acoustic signals classified in the learning phase (for example, see Patent Document 2).

As a method of changing setting through another device other than the hearing aid main body, as for adjustment of an acoustic parameter, there is a technique in which a mobile device is connected to a server and a hearing chart database through a network and which can adjust the sound quality of the mobile device (for example, see Patent Document 3).

Further, there is a technique in which a telephone generates a control signal of a hearing aid and converts the control signal together with a receiving signal into a sound wave and transmits the sound wave. FIG. 12 is a block diagram to show a configuration example of such a remote control hearing aid system. This remote control hearing aid system includes a telephone 10 and a hearing aid 40.

When a telephone call starts, a call detection unit 6 of the telephone 10 detects the call. When the call detection unit 6 detects the call, a control signal generation unit 5 generates a control signal. The control signal and a receiving signal are converted into an acoustic signal by an electroacoustic transducer 4 and the acoustic signal is transmitted to the hearing aid 40.

The transmitted acoustic signal is received by a sound wave reception unit 41 of the hearing aid 40 and is converted into reception signal of an electric signal. The reception signal provided by the sound wave reception unit 41 is sent through a reception switch unit 43 to a power amplification unit 44 and an analysis control unit 46. The sent reception signal is subjected to frequency analysis and is compared with a stored signal in the analysis control unit 46, whereby a control signal is generated. The control signal is sent to the power amplification unit 44 and is used to change the amplification factor of the reception signal (for example, see Patent Document 4).

RELATED ART DOCUMENTS

Patent Documents

Patent Document 1: JP-A-9-18998
Patent Document 2: JP-A-2005-203981
Patent Document 3: JP-B-3482465
Patent Document 4: JP-A-2006-229866

DISCLOSURE OF THE INVENTION

Problem to be Solved by the Invention

However, the conventional hearing aid described above involves a problem in that when the user consciously changes setting of the hearing aid main body, the volume change button and the operation mode change button are small and the user cannot directly see the buttons at the hearing aid wearing time and it is difficult for the user to change the setting. On the other hand, the technique of automatically changing setting of the hearing aid in response to the sound environment has the advantage that operation is not required, but involves a problem in that intention of the user and the setting do not necessarily match. The technique of changing setting with a different device other than the hearing aid main body has the constraint that the user cannot change setting as intended unless the user always carries the separated device. In the technique, the acoustic parameter is adjusted using external devices of the server, the database, the telephone, etc., and in order to adjust the acoustic parameter using the external devices, the user hears a dissonant adjustment sound at the setting time with a mobile telephone and feels his or her displeasure.

In view of the circumstances described above, an object of the invention is to provide a hearing aid and a hearing aid system which can reflect setting change of the hearing aid responsive to a sound environment by the user as he or she intends, which can prevent the user from feeling his or her inconvenience or displeasure caused by changing setting of the hearing aid, and which can allow the user to easily change the setting.

Means for Solving the Problem

A hearing aid of the invention comprises: a microphone configured to generate an input signal from an input sound; a signal processing unit configured to generate an output signal from the input signal; and a receiver configured to play an output sound from the output signal, wherein the signal processing unit determines a time response of the input signal based on a contact sound generated when the hearing aid is contacted in a predetermined time period, and changes setting of the hearing aid based on the time response.

According to the configuration described above, the time response of the input signal is determined and setting of the hearing aid is changed based on the time response, so that setting of the hearing aid (acoustic parameters of volume, operation mode, etc.,) can be easily changed without performing button operation of a miniaturized hearing aid and by only using the hearing aid without using another device.

In the hearing aid of the invention, the signal processing unit calculates an intensity of the input signal, and changes the setting of the hearing aid when the signal processing unit detects at least two time points, each at which an average value of the intensity of the input signal in a predetermined time period is equal to or less than a first predetermined threshold value and also at which the intensity of the input signal in the predetermined time period becomes equal to or more than a second predetermined threshold value.

According to the configuration described above, the setting is changed by detecting two or more cases where the intensity of the input signal becomes equal to or more than the second predetermined threshold value, so that setting of the hearing aid can be reliably changed in a noisy ordinary environment.

In the hearing aid of the invention, the signal processing unit sets a time width for detecting the time point at which the intensity of the input signal becomes equal to or more than the second predetermined threshold value.

According to the configuration described above, the time width is set as needed, whereby erroneous detection can be reduced according to the use environment of the hearing aid wearer.

In the hearing aid of the invention, the contact sound is a flick or tap sound by a tip of a nail, and the signal processing unit sets the time width to 20 msec or less.

According to the configuration described above, for example, it is possible to prevent a case in which the contact sound can not be detected because the time width is too narrow, and also possible to prevent erroneous detection of a sound other than the contact sound because the time width is too wide.

In the hearing aid of the invention, the signal processing unit decreases the signal intensity for the time width in which the time point at which the intensity of the input signal becomes equal to or more than the second predetermined threshold value is detected.

According to the configuration described above, the intensity of the input signal is decreased for the time width in which the case where the intensity of the input signal becomes equal to or more than the second predetermined threshold value is detected, so that when setting of the hearing aid is changed, a displeasure sense is not given to the hearing aid wearer.

In the hearing aid of the invention, the signal processing unit calculates an intensity of the input signal, and changes the setting of the hearing aid when the signal processing unit detects at least two time points, each at which an average value of the intensity of the input signal in a predetermined time period is equal to or less than a first predetermined threshold value, and also at which a difference between the waveform of a signal in a frequency domain obtained by converting the input signal and a waveform of a predetermined signal becomes equal to or less than a third predetermined threshold value.

According to the configuration described above, the setting is changed by detecting two or more cases where the difference between the waveform of the frequency signal and the waveform of the predetermined signal is equal to or less than the third predetermined threshold value, so that setting of the hearing aid can also be reliably changed in a noisy ordinary environment.

In the hearing aid of the invention, the signal processing unit sets a time width for detecting the time point at which the difference between the waveform of the signal in the frequency domain and the waveform of the predetermined signal is equal to or less than the third predetermined threshold value.

According to the configuration described above, the time width is set as needed, whereby erroneous detection can be reduced according to the use environment of the hearing aid wearer.

In the hearing aid of the invention, the contact sound is a flick or tap sound by a tip of a nail, and the signal processing unit sets the time width to 20 msec.

According to the configuration described above, for example, it is possible to prevent a case in which the contact sound can not be detected because the time width is too narrow, and also possible to prevent erroneous detection of a sound other than the contact sound because the time width is too wide.

In the hearing aid of the invention, the signal processing unit decreases the signal intensity for the time width in which the time point at which the difference between the waveform of the signal in the frequency domain and the waveform of the predetermined signal is equal to or less than the third predetermined threshold value is detected.

According to the configuration described above, the intensity of the input signal is decreased for the time width in which the case where the difference between the waveform of the frequency signal and the waveform of the predetermined signal is equal to or less than the third predetermined threshold value is detected, so that when setting of the hearing aid is changed, a displeasure sense is not given to the hearing aid wearer.

In the hearing aid of the invention, the signal processing unit indicates that the setting of the hearing aid has been changed.

According to the configuration described above, after setting change, the hearing aid wearer is informed of the setting change, so that an uncertain, insecure feeling of the hearing aid wearer as to whether or not setting has been changed can be eliminated.

A hearing aid system of the invention comprises a hearing aid and a hearing aid setting device configured to change setting of the hearing aid, wherein the hearing aid setting device comprises: an input unit configured to input setting of the hearing aid; a storage unit configured to store information of a maskee sound indicating an adjustment sound output at a change of setting of the hearing aid and a masker sound for masking the maskee sound; a signal synthesis unit configured to generate an output signal based on the masker sound and the maskee sound stored in the storage unit and the setting of the hearing aid input through the input unit; and a speaker configured to play a setting sound from the output signal, and wherein the hearing aid comprises: a microphone configured to generate a setting signal from the setting sound played by the hearing aid setting device; and a signal processing unit configured to extract the maskee sound from the setting signal, extract setting of the hearing aid from the extracted maskee sound, and change the setting of the hearing aid based on the extracted setting of the hearing aid.

According to the configuration described above, a dissonant adjustment sound is not heard at the setting change time and a displeasure sense is not given to the hearing aid wearer.

In the hearing aid system of the invention, a signal intensity of a signal indicating the maskee sound is equal to or less than a signal intensity of a signal indicating the masker sound.

According to the configuration described above, the maskee sound is set to the masking level or less of the masker sound, so that a dissonant adjustment sound is not heard at the setting time and a displeasure sense is not given to the hearing aid wearer.

In the hearing aid system of the invention, the maskee sound is a pure sound.

According to the configuration described above, the maskee sound is a pure sound, whereby the circuit configuration for masking can be simplified.

In the hearing aid system of the invention, the signal processing unit of the hearing aid indicates that the setting of the hearing aid has been changed.

According to the configuration described above, after setting change, the hearing aid wearer is informed of the setting change, so that an uncertain, insecure feeling of the hearing aid wearer as to whether or not setting has been changed can be eliminated.

In the hearing aid system of the invention, the masker sound contains a frequency component other than the frequency component contained in the maskee sound.

According to the configuration described above, it becomes easy to extract the masked maskee sound from the masking masker sound.

In the hearing aid of the invention, the signal processing unit calculates an intensity of the input signal, detects a number of times an average value of the intensity of the input signal in a predetermined time period is equal to or less than a first predetermined threshold value and also the intensity of the input signal in the predetermined time period becomes equal to or more than a second predetermined threshold value, and distinguishes a plurality of settings of the hearing aid and changes the setting based on the number of times.

According to the configuration described above, a plurality of settings can be easily distinguished, and the setting can be changed in response to the number of times without performing button operation.

A hearing aid of the invention comprises: a first microphone configured to generate a first input signal from an input sound; a second microphone configured to generate a second input signal from the input sound; a signal processing unit configured to generate an output signal from the first input signal and the second input signal; and a receiver configured to play an output sound from the output signal, wherein the signal processing unit determines time responses of the first input signal and the second input signal based on a contact sound generated when the hearing aid is contacted in a predetermined time period, and distinguishes a plurality of settings of the hearing aid and changes the setting based on the time responses.

According to the configuration described above, the time responses of the two input signals are determined and setting of the hearing aid is changed based on the time responses, so that setting of the hearing aid (acoustic parameters of volume, operation mode, etc.,) can be easily changed without performing button operation of a miniaturized hearing aid and by only using the hearing aid without using another device. Further, a plurality of settings can be easily distinguished, and the setting can be changed based on the time responses of the two input signals without performing button operation.

In the hearing aid of the invention, the signal processing unit compares amplitude values of the first input signal and the second input signal, and distinguishes the plurality of settings of the hearing aid and changes the setting based on the amplitude values.

According to the configuration described above, different settings (for example, setting of a volume increase and setting of a volume decrease) can be made in the case where a contact sound is input only to the first microphone and the case where a contact sound is input only to the second microphone, for example.

In the hearing aid of the invention, the signal processing unit determines a time difference between amplitude peak time points of the first input signal and the second input signal, and distinguishes the plurality of settings of the hearing aid and changes the setting based on the time difference between the amplitude peak time points.

According to the configuration described above, different settings (for example, setting of a volume increase and setting of a volume decrease) can be made in the case where a contact sound is input to the first microphone and then a contact sound is input to the second microphone and the case where a contact sound is input to the second microphone and then a contact sound is input to the first microphone, for example.

Advantages of the Invention

According to the invention, setting of the hearing aid (acoustic parameters of volume, operation mode, etc.,) can be easily changed only by using the hearing aid without performing button operation of a miniaturized hearing aid and without using another device.

Hearing aid setting is extracted from the extracted maskee sound, and setting is changed based on the extracted hearing aid setting, so that a dissonant adjustment sound is not heard at the setting change time, and a displeasure sense is not given to the hearing aid wearer.

MODE FOR CARRYING OUT THE INVENTION

In a hearing aid in an embodiment of the invention, the hearing aid detects a sound produced as a hearing aid wearer contacts a hearing aid main body (contact sound) and changes setting (changes an acoustic parameter). For example, if amplitude fluctuation of an input signal exceeds a signal of a second predetermined threshold value or more at least twice in a range of a first predetermined threshold value or less (for example, a state in which no undesired sound exists), setting of the hearing aid is changed. That is, time response of an input signal based on a contact sound generated at the contact time of the hearing aid in a predetermined time period is determined and setting of the hearing aid is changed based on the time response. In this case, the frequency characteristic of the input signal may be limited.

The acoustic parameters include an environment parameter indicating the environment surrounding the hearing aid, an output parameter indicating the output level of the hearing aid, a noise suppression parameter indicating the suppression level of suppressing noise in the surrounding of the hearing aid, etc. In the embodiments, setting and changing of the acoustic parameter may be called simply setting and changing.

The contact sound includes a sound produced as the hearing aid wearer flicks the tip of his or her nail against the hearing aid main body, a tap sound of the tip of his or her nail, a sound produced by stroking a microphone, etc. A sound generated in the body of the hearing aid wearer (an occlusion sound of teeth, a gnashing sound, a whistle sound, a tutting sound, etc.,) may be used.

In the hearing aid of the embodiment of the invention, a played sound from an adjustment device (for example, mobile telephone) is made a masker sound (masking sound) and a hearing aid adjustment sound is made a maskee sound (masked sound) for making the hearing aid adjustment sound inconspicuous. The hearing aid adjustment sound is set to the making level or less of the masker sound (played sound).

First Embodiment

Figure 1:
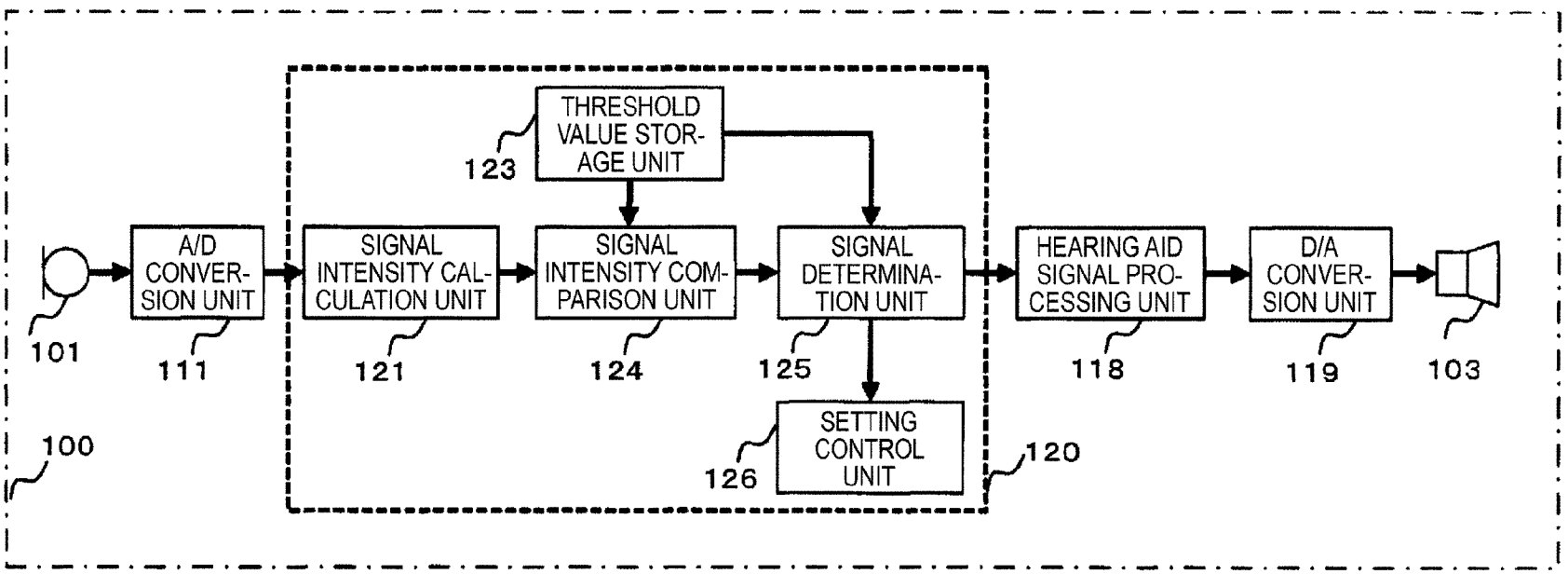
FIG. 1 is a block diagram to show an example of the schematic configuration of a hearing aid according to a first embodiment of the invention.

FIG. 1 is a block diagram to shown an example of the schematic configuration of a hearing aid according to a first embodiment of the invention. A hearing aid 100 shown in FIG. 1 includes a microphone 101 for generating an input signal from an input sound, an A/D conversion unit 111 for converting the input signal into a digital signal, a signal processing unit 120 for processing the input signal and generating an output signal, a hearing aid signal processing unit 118 for adjusting the frequency characteristic, etc., of a sound signal as the input signal, namely, controlling the frequency characteristic, etc., a D/A conversion unit 119 for converting the digital signal into an analog signal, and a receiver 103 for playing an output sound from an output signal of the provided analog signal.

Signal processing for the hearing aid includes, for example, nonlinear compression processing for amplifying, etc., a sound signal input at a different amplification factor for each frequency, noise suppression processing for suppressing a noise component input from the microphone 101, and the like. The signal processing for the hearing aid can be performed based on an acoustic parameter as hearing aid setting.

The signal processing unit 120 has a signal intensity calculation unit 121 for calculating the intensity of an input signal, a threshold value storage unit 123 for storing a predetermined threshold value to be compared with the signal intensity of an input signal, a signal intensity comparison unit 124 for making a comparison between the signal intensity of the input signal and the predetermined threshold value, a signal determination unit 125 for determining a time response of the input signal based on the predetermined threshold value and the comparison result, and a setting control unit 126 for changing setting of the hearing aid based on the determination of the time response.

When the signal determination unit 125 detects at least two time points, each at which the average value of the input signal intensity within a predetermined time period is equal to or less than a first threshold value and also at which the input signal intensity within the predetermined time period becomes equal to or more than a second threshold value, the signal determination unit 125 outputs a signal for changing the setting of the hearing aid to the setting control unit 126.

At this time, to decrease erroneous detection, the signal determination unit 125 can set the time width for detecting the time point at which the input signal intensity within the predetermined time period becomes equal to or more than the second threshold value. It is considered that a sound produced as the hearing aid wearer flicks the tip of his or her nail against the hearing aid main body (the sound is represented as "nail-tip flick sound") or a sound produced as the hearing aid wearer taps on the hearing aid main body with the tip of his or her nail (the sound is represented as "nail-tip tap sound") is used as contact sound of the hearing aid main body by the hearing aid wearer. In this case, the time width from the start to the end of a nail-tip flick sound or a nail-tip tap sound as one contact sound can be set to 5 msec or more and 20 msec or less, for example. Considering the processing amount of the signal processing unit 120, preferably the time width is 5 msec or more; it may be less than 5 msec because of development of the frequency analysis processing function of the signal processing unit 120. For a sound produced by stroking the microphone and a sound produced in the body of the hearing aid wearer, the time width is prolonged. The time width for detecting the nail-tip flick sound or the nail-tip tap sound is shortened as much as possible; for example, it may be 1 msec. The time width for detecting a contact sound is shortened, whereby time rising of amplitude caused by a contact sound can be detected precisely. To prevent erroneous detection, smoothing processing of the amplitude value of an input signal in a short time width is performed or averaging processing is performed within a predetermined time period, whereby the detection accuracy of a contact sound can be improved.

If the signal determination unit 125 determines that the signal is a signal for setting the hearing aid, the signal is input to the setting control unit 126 as a setting signal and the setting of the hearing aid is changed by the setting control unit 126.

At this time, a contact sound generated for setting the hearing aid is unpleasant for the hearing aid wearer and thus the signal processing unit 120 can decrease the signal intensity for the time width detecting the time point at which the input signal intensity becomes equal to or greater than the second predetermined threshold value within the predetermined time period. As an example of a method of decreasing the signal intensity, a method of converting the input signal intensity into a value less than the first predetermined threshold value, a method of converting the input signal intensity into a value less than the second predetermined threshold value, a method of converting into the sound pressure level equal to that in a time period at which no contact sound is generated, etc., is considered. As a specific example of a method of suppressing the signal intensity, a method described in JP-A-1-149508 can be applied or an impact sound suppression method described in JP-A-6-276599 can be applied.

Next, output from the signal processing unit 120 is input to the hearing aid signal processing unit 118 as a signal provided by decreasing the signal intensity of a contact sound generated for changing setting of the hearing aid for the output signal of the A/D conversion unit 111. The hearing aid signal processing unit 118 executes necessary signal processing as the hearing aid, such as directivity synthesis processing, noise suppression processing, howling suppression processing, and nonlinear compression processing.

If the signal determination unit 125 determines that the signal is a signal for setting the hearing aid and the setting control unit 126 changes setting, the hearing aid signal processing unit 118 adds a signal for informing the hearing aid wearer that the setting change is complete. As an example of an informing method, it is considered that a report sound is generated or that a report is generated by voice.

Figure 2:
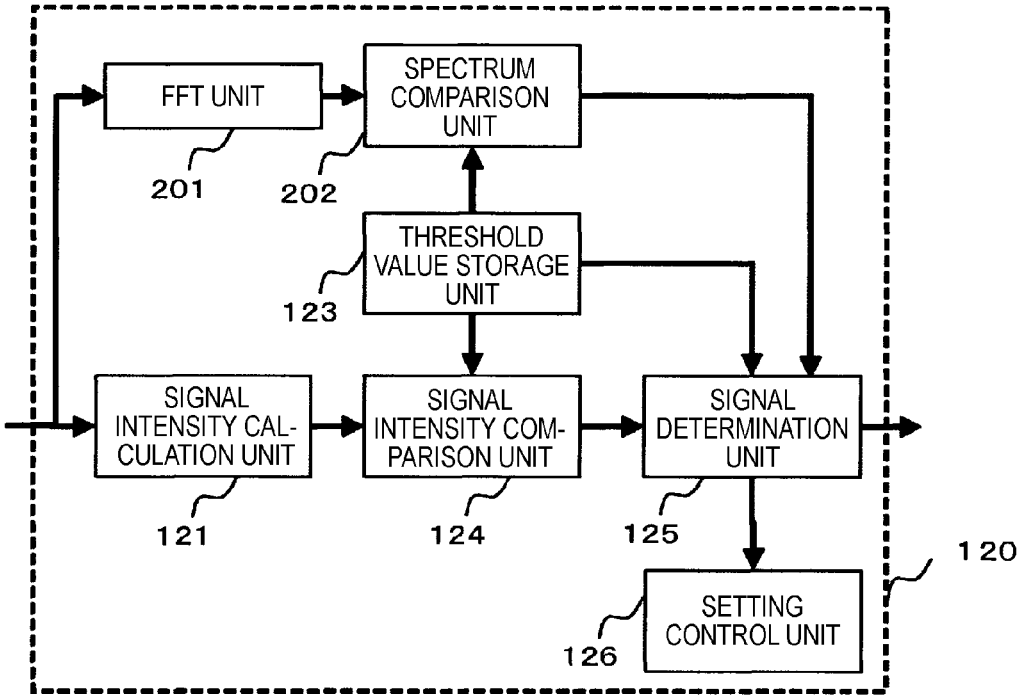
FIG. 2 is a block diagram to show an example of the internal configuration of a signal processing unit in the hearing aid of the first embodiment of the invention.

Further, the signal processing unit 120 can be configured as in FIG. 2 rather than as in FIG. 1. As compared with the signal processing unit 120 shown in FIG. 1, the signal processing unit 120 shown in FIG. 2 is provided by adding an FFT unit 201 for executing fast Fourier transform of an input signal, thereby converting the signal into data in a frequency domain and a spectrum comparison unit 202 for comparing spectrum of the data in the frequency domain. That is, the signal processing unit 120 in FIG. 1 makes a determination about a time response; the signal processing unit 120 in FIG. 2 makes a determination about a frequency component of an input signal.

When the signal determination unit 125 detects at least two time points, at which the average value of the input signal intensity within the predetermined time period is equal to or less than the first predetermined threshold value and also at which the difference between the waveform of the signal in the frequency domain obtained by converting the input signal and the waveform of a predetermined signal becomes equal to or less than a third predetermined threshold value, the signal determination unit 125 changes the setting of the hearing aid. That is, the setting of the hearing aid is changed in response to the analysis result of the signal in the frequency domain. The waveform of the predetermined signal is stored in the threshold value storage unit 123.

To decrease erroneous detection, the signal determination unit 125 can set the time width for detecting the time point at which the difference between the waveform of the signal in the frequency domain and the waveform of the predetermined signal becomes equal to or less than the third predetermined threshold value. It is considered that a nail-tip flick sound or a nail-tip tap sound is used as contact sound of the hearing aid main body by the hearing aid wearer. In this case, the time width from the start to the end of the nail-tip flick sound or the nail-tip tap sound as one contact sound can be set to 20 msec or less, for example. For a sound produced by stroking the microphone and a sound produced in the body of the hearing aid wearer, the time width is prolonged.

If the signal determination unit 125 determines that the signal is a signal for setting the hearing aid, the signal is input to the setting control unit 126 as a setting signal and the setting of the hearing aid is changed by the setting control unit 126.

At this time, a contact sound generated for setting the hearing aid is unpleasant for the hearing aid wearer and thus the signal processing unit 120 can decrease the signal intensity for the time width detecting the time point at which the difference between the waveform of the frequency signal and the waveform of the predetermined signal becomes equal to or less than the third predetermined threshold value within the predetermined time period. As an example of a method of decreasing the signal intensity, a method of converting the input signal intensity into a value less than the first predetermined threshold value, a method of converting into the sound pressure level equal to that in a time period at which no contact sound is generated, etc., is considered.

Next, output from the signal processing unit 120 is input to the hearing aid signal processing unit 118 as a signal provided by decreasing the signal intensity of a contact sound generated for changing setting of the hearing aid for the output signal of the A/D conversion unit 111. The hearing aid signal processing unit 118 executes necessary signal processing as the hearing aid, such as directivity synthesis processing, noise suppression processing, howling suppression processing, and nonlinear compression processing.

If the signal determination unit 125 determines that the signal is a signal for setting the hearing aid and the setting control unit 126 changes setting, the hearing aid signal processing unit 118 adds a signal for informing the hearing aid wearer that the setting change is complete. As an example of an informing method, it is considered that a report sound is generated or that a report is generated by voice.

To distinguish different settings of the hearing aid 100 such as setting of volume increase, setting of volume decrease, etc., in volume setting as an example of hearing aid setting change, a plurality of determination criteria by the signal determination unit 125 may be provided. For example, to distinguish between setting of volume increase and setting of volume decrease, if the signal determination unit 125 detects two time points, at which the average value of the input signal intensity within the predetermined time period is equal to or less than the first threshold value and also at which the input signal intensity within the predetermined time period becomes equal to or more than the second predetermined value, it can be determined that the volume increases and if the signal determination unit 125 detects three times or more, it can be determined that the volume decreases. That is, a plurality of settings of the hearing aid 100 can be distinguished and changed based on the number of detection times. In so doing, it is made possible to distinguish intention of setting change of the hearing aid wearer by the signal determination unit 125 of the hearing aid.

It is considered that the type of contact sound generated by different operation of the hearing aid 100 by the hearing aid wearer, for example, a nail-tip flick sound, a nail-tip tap sound, a stroke sound with a finger pulp, a sound produced in the body of the hearing aid wearer, etc., is distinguished from the signal amplitude, time fluctuation, frequency characteristic, etc., and is used as a different control signal. Accordingly, it is made possible to distinguish intention of setting change of the hearing aid wearer by the signal determination unit 125 of the hearing aid 100. Accordingly, a plurality of settings can be distinguished and changed and it is made possible to decrease the number of setting change operation times of the hearing aid wearer and circumvent unintended setting change.

Thus, according to the hearing aid according to the embodiment, a time response of an input signal is determined and setting of the hearing aid is changed based on the time response, so that setting of the hearing aid (acoustic parameters of volume, operation mode, etc.,) can be easily changed only with the hearing aid without performing button operation of a miniaturized hearing aid and without using another device. Particularly, if elderly people is a hearing aid wearer, it is difficult to operate a miniaturized hearing aid and thus the hearing aid of the embodiment is very useful.

(Experimental Result)

Next, time response when various contact sounds are input to the hearing aid of the embodiment will be discussed. Here, a behind-the-ear hearing aid and a small-size behind-the-ear hearing aid are used as the hearing aids. The behind-the-ear hearing aid refers to a hearing aid with the overall length of a hearing aid main body (the main body refers to a main body portion except a hunger portion or a tube portion) being about 3 cm or more, and the small-size behind-the-ear hearing aid refers to a hearing aid with the overall length of a hearing aid main body being less than about 3 cm.

Figure 5:
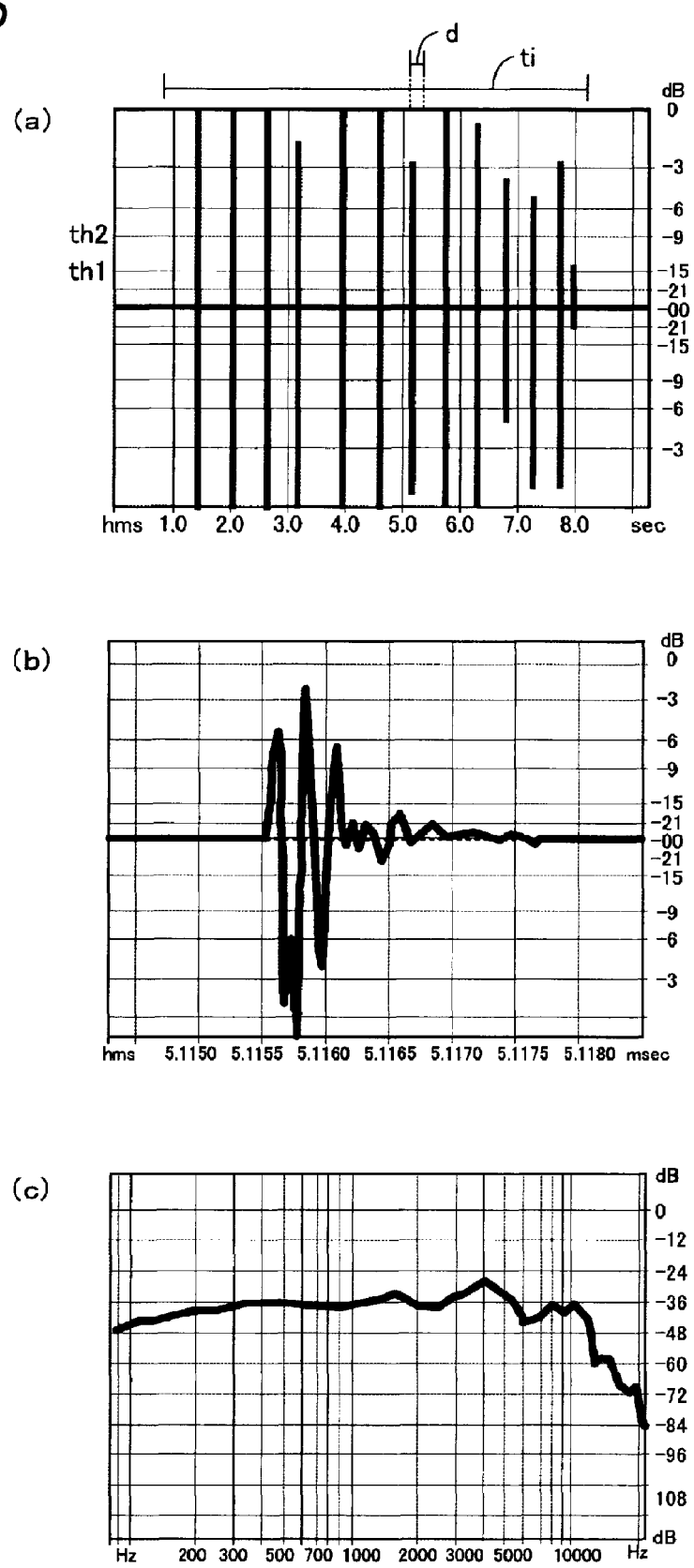
FIG. 5 is a drawing to show an example of time response when a flick sound by a tip of nail is applied to a behind-the-ear hearing aid (experiment model A) as operation of the hearing aid wearer in the first embodiment of the invention.

FIG. 5 is a graph when a nail-tip flick sound (an example of a contact sound) is applied to a behind-the-ear hearing aid (experiment model A) as operation of the hearing aid wearer. FIG. 5(*a*) shows time response of input signal amplitude, the horizontal axis indicates the time (in second units), and the vertical axis indicates sound pressure level (here, the maximum input sound pressure level is described as 0 dB). FIG. 5(*b*) is an enlarged drawing in the time direction of an impulse waveform of time response, the horizontal axis indicates the time (in millisecond units), and the vertical axis indicates sound pressure level. FIG. 5(*c*) shows the frequency characteristic of time response, the horizontal axis indicates frequency (in Hz units), and the vertical axis indicates sound pressure level.

In FIG. 5(*a*), th1 (line of −15 dB)) indicates an example of the first predetermined threshold value and th2 (line of −9 dB) indicates an example of the second predetermined threshold value. ti indicates an example of the predetermined time width and d indicates an example of the time width. Referring to FIG. 5, it is understood that the time point at which the time response becomes the second threshold value in the predetermined time period ti occurs twice or more. In this case, in the signal processing unit, it is determined that the input signal is a contact sound, and setting of the hearing aid is changed.

Figure 6:
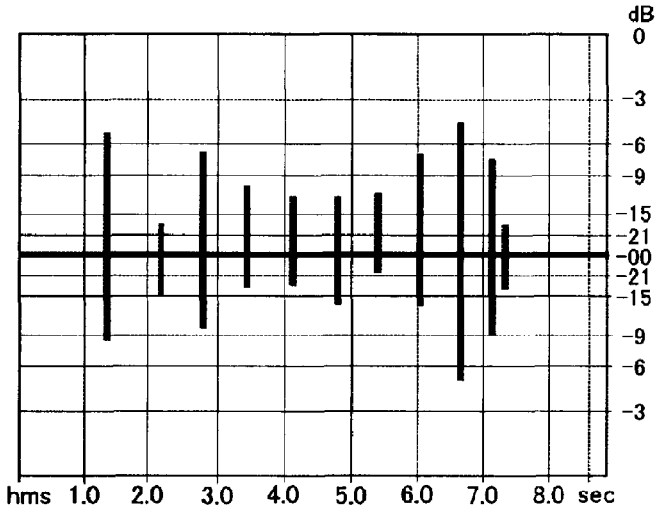
FIG. 6 is a drawing to show an example of time response when a flick sound by a tip of nail is applied to a small-size behind-the-ear hearing aid (experiment model B) as operation of the hearing aid wearer in the first embodiment of the invention.
Figure 6:
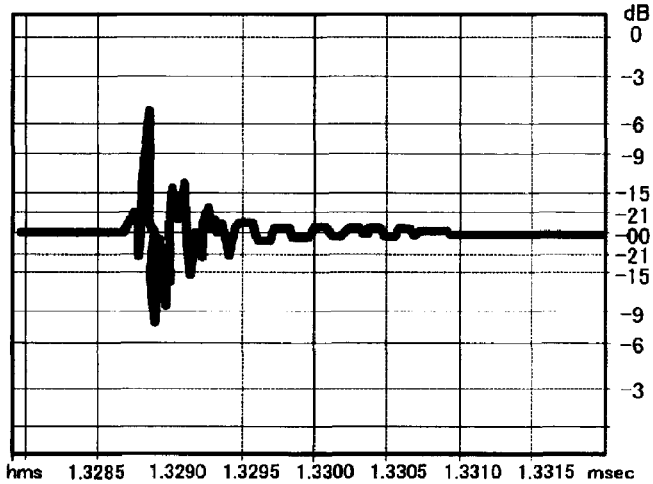
Figure 6:
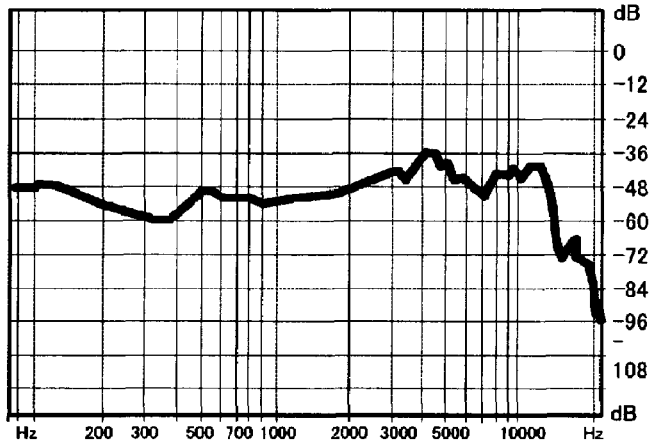

FIG. 6 is a graph when a nail-tip flick sound (an example of a contact sound) is applied to a small-size behind-the-ear hearing aid (experiment model B) as operation of the hearing aid wearer. FIG. 6(*a*) shows time response of input signal amplitude, the horizontal axis indicates the time (in second units), and the vertical axis indicates sound pressure level. FIG. 6(*b*) is an enlarged drawing in the time direction of an impulse waveform of time response, the horizontal axis indicates the time (in millisecond units), and the vertical axis indicates sound pressure level. FIG. 6(*c*) shows the frequency characteristic of time response, the horizontal axis indicates frequency (in Hz units), and the vertical axis indicates sound pressure level.

As for the behind-the-ear hearing aid and the small-size behind-the-ear hearing aid, when the time response of the input signal amplitude in FIG. 6(*a*) is compared with an example of another contact sound, it can be understood that the sound pressure level of the nail-tip flick sound is large. Therefore, when the hearing aid wearer flicks the tip of his or her nail against the hearing aids, the sound pressure level reliably exceeds the second predetermined threshold value and setting of the hearing aid can be reliably changed.

Figure 7:
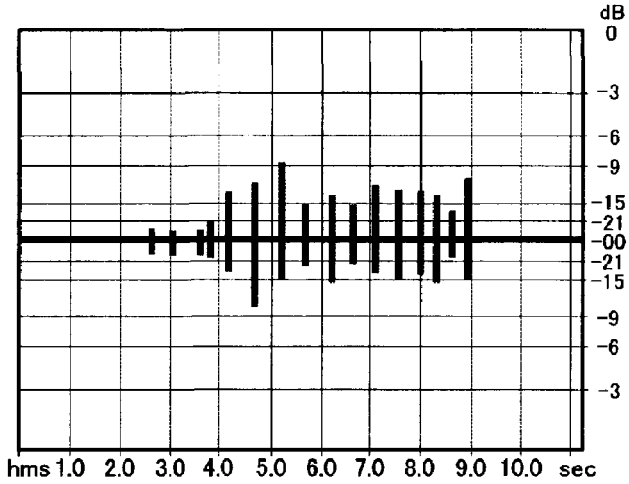
FIG. 7 is a drawing to show an example of time response when a tap sound by a tip of nail is applied to the behind-the-ear hearing aid (experiment model A) as operation of the hearing aid wearer in the first embodiment of the invention.
Figure 7:
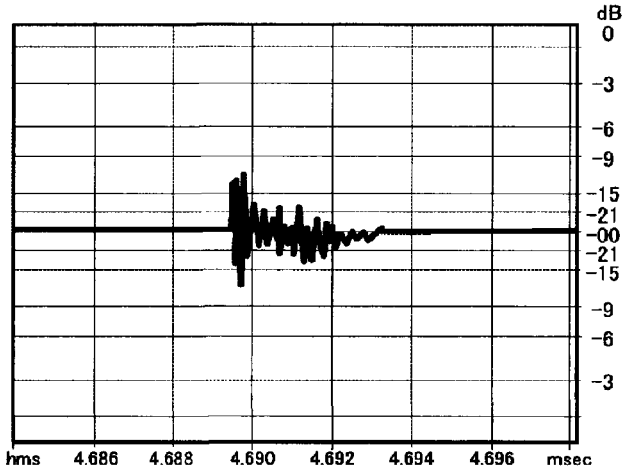
Figure 7:
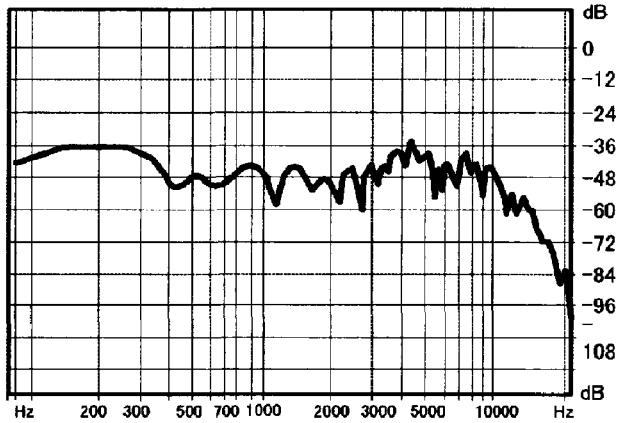

FIG. 7 is a graph when a nail-tip tap sound (an example of a contact sound) is applied to the behind-the-ear hearing aid (experiment model A) as operation of the hearing aid wearer. FIG. 7(*a*) shows time response of input signal amplitude, the horizontal axis indicates the time (in second units), and the vertical axis indicates sound pressure level. FIG. 7(*b*) is an enlarged drawing in the time direction of an impulse waveform of time response, the horizontal axis indicates the time (in millisecond units), and the vertical axis indicates sound pressure level. FIG. 7(*c*) shows the frequency characteristic of time response, the horizontal axis indicates frequency (in Hz units), and the vertical axis indicates sound pressure level.

Figure 8:
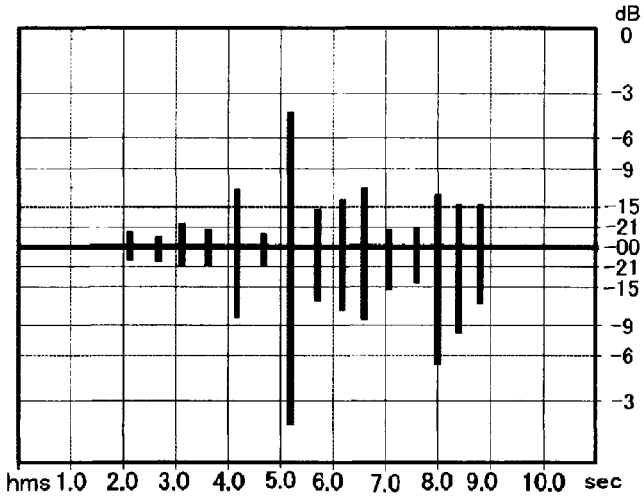
FIG. 8 is a drawing to show an example of time response when a tap sound by a tip of nail is applied to the small-size behind-the-ear hearing aid (experiment model B) as operation of the hearing aid wearer in the first embodiment of the invention.
Figure 8:
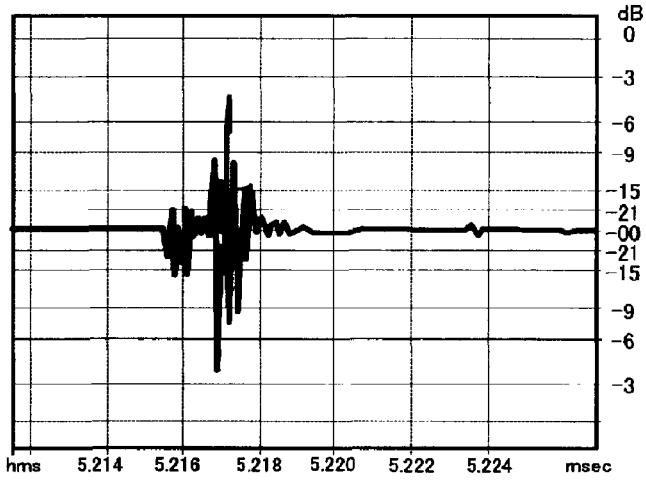
Figure 8:
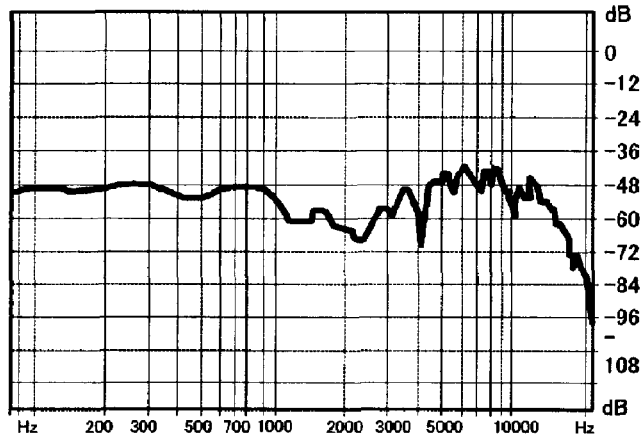

FIG. 8 is a graph when a nail-tip tap sound (an example of a contact sound) is applied to the small-size behind-the-ear hearing aid (experiment model B) as operation of the hearing aid wearer. FIG. 8(*a*) shows time response of input signal amplitude, the horizontal axis indicates the time (in second units), and the vertical axis indicates sound pressure level. FIG. 8(*b*) is an enlarged drawing in the time direction of an impulse waveform of time response, the horizontal axis indicates the time (in millisecond units), and the vertical axis indicates sound pressure level. FIG. 8(*c*) shows the frequency characteristic of time response, the horizontal axis indicates frequency (in Hz units), and the vertical axis indicates sound pressure level.

Figure 9:
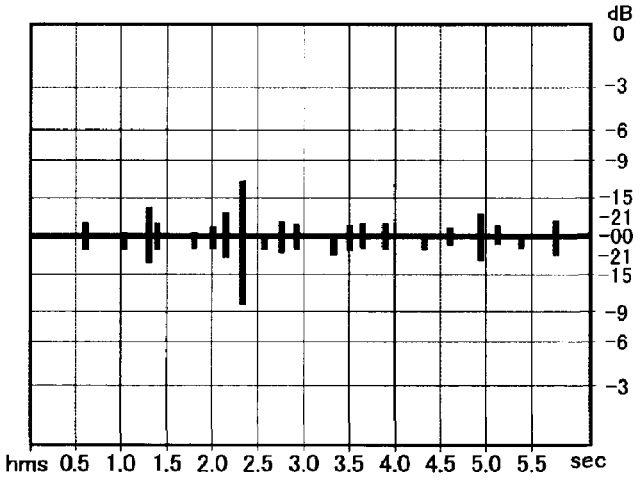
FIG. 9 is a drawing to show an example of time response when a stroke sound with a finger pulp is applied to the hearing aid as operation of the hearing aid wearer in the first embodiment of the invention.
Figure 9:
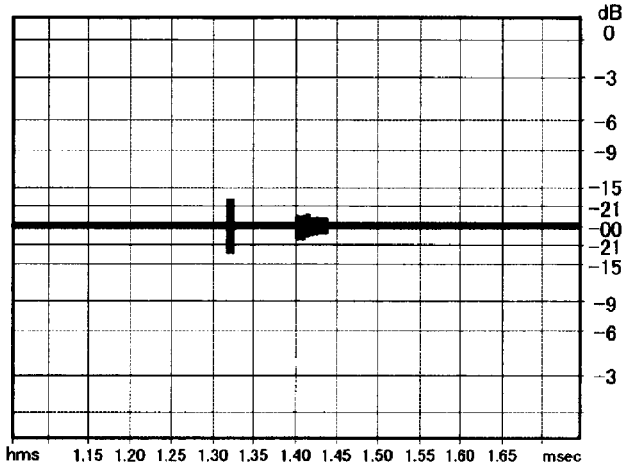
Figure 9:
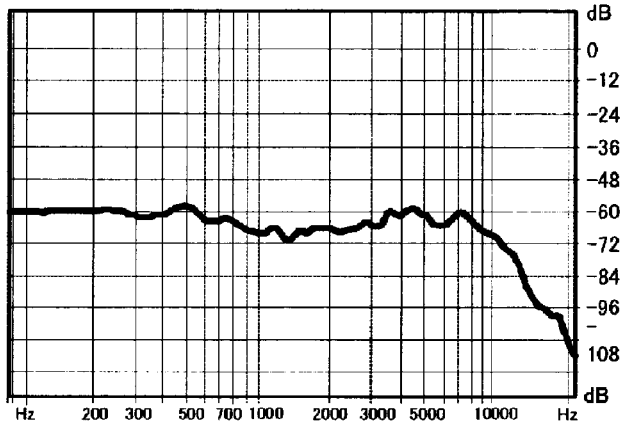

FIG. 9 is a graph when a stroke sound with a finger pulp (an example of a contact sound) is applied to the hearing aid as operation of the hearing aid wearer. FIG. 9(*a*) shows time response of input signal amplitude, the horizontal axis indicates the time (in second units), and the vertical axis indicates sound pressure level. FIG. 9(*b*) is an enlarged drawing in the time direction of an impulse waveform of time response, the horizontal axis indicates the time (in millisecond units), and the vertical axis indicates sound pressure level. FIG. 9(*c*) shows the frequency characteristic of time response, the horizontal axis indicates frequency (in Hz units), and the vertical axis indicates sound pressure level. When the hearing aid is stroked with a finger pulp, the recording microphone 101 and the sound source are very close to each other and thus the effect caused by the difference between the hearing aid shapes (behind-the-ear hearing aid and in-the-ear hearing aid) is small as compared with nail-tip flick sound, nail-tip tap sound, and sound produced in the body of the hearing aid wearer.

Figure 10:
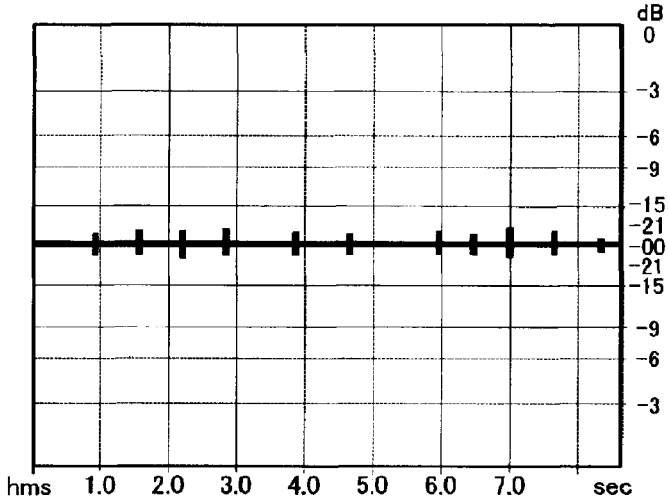
FIG. 10 is a drawing to show an example of time response when a chewing sound is applied to the behind-the-ear hearing aid as operation of the hearing aid wearer (the measurement place is an upper part of a pinna) in the first embodiment of the invention.
Figure 10:
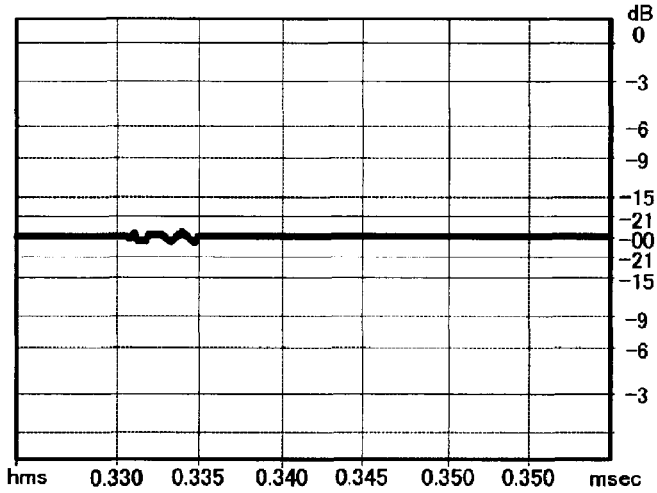
Figure 10:
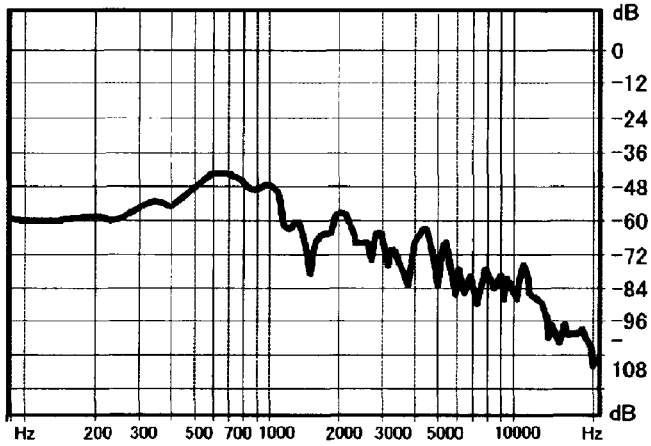

FIG. 10 is a graph when a chewing sound (an example of a contact sound) is applied to the behind-the-ear hearing aid as operation of the hearing aid wearer (the measurement place is an upper part of a pinna). FIG. 10(*a*) shows time response of input signal amplitude, the horizontal axis indicates the time (in second units), and the vertical axis indicates sound pressure level. FIG. 10(*b*) is an enlarged drawing in the time direction of an impulse waveform of time response, the horizontal axis indicates the time (in millisecond units), and the vertical axis indicates sound pressure level. FIG. 10(*c*) shows the frequency characteristic of time response, the horizontal axis indicates frequency (in Hz units), and the vertical axis indicates sound pressure level.

Figure 11:
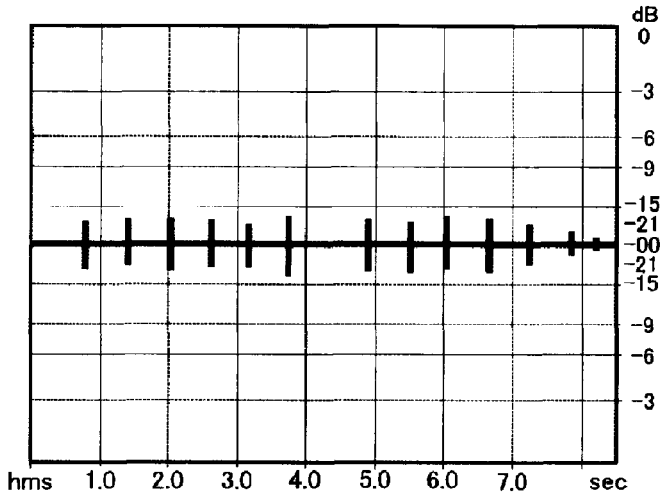
FIG. 11 is a drawing to show an example of time response when a chewing sound is applied to an in-the-ear hearing aid as operation of the hearing aid wearer (the measurement place is the inside of an external auditory meatus) in the first embodiment of the invention.
Figure 11:
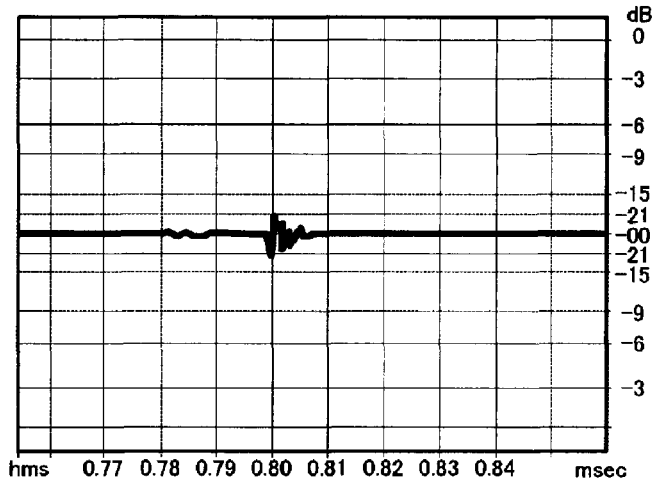
Figure 11:
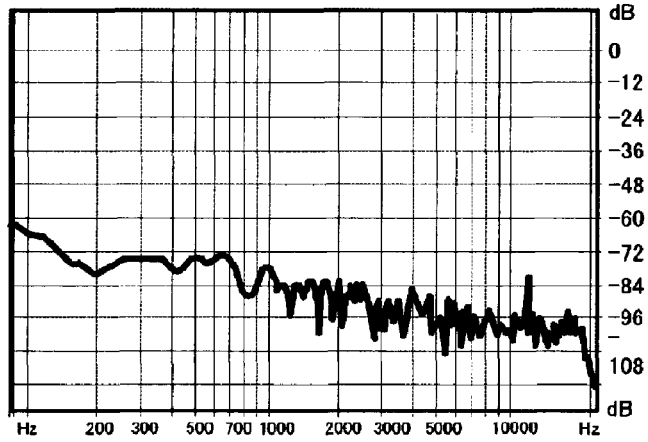
Figure 12:
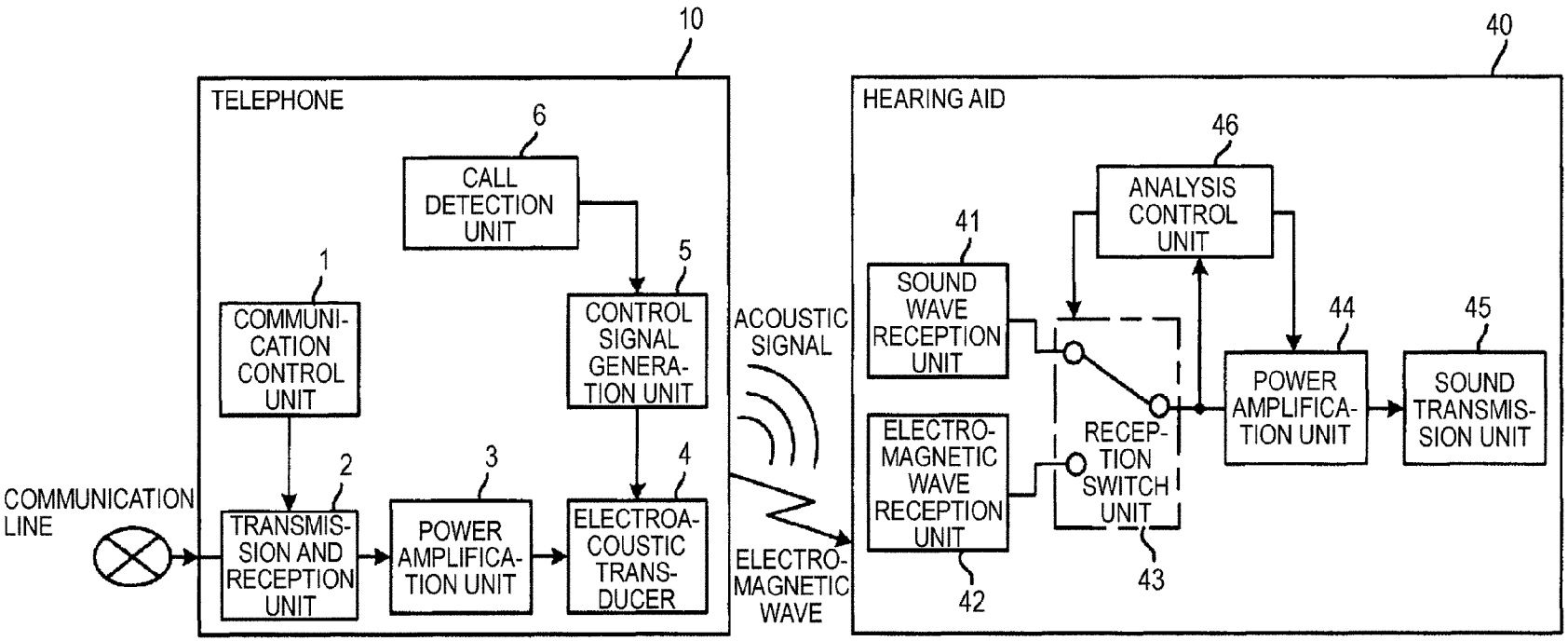
FIG. 12 is a block diagram to show a configuration example of a conventional remote control hearing aid system.

FIG. 11 is a graph when a chewing sound (an example of a contact sound) is applied to an in-the-ear hearing aid as operation of the hearing aid wearer (the measurement place is the inside of an external auditory meatus). FIG. 11(*a*) shows time response of input signal amplitude, the horizontal axis indicates the time (in second units), and the vertical axis indicates sound pressure level. FIG. 11(*b*) is an enlarged drawing in the time direction of an impulse waveform of time response, the horizontal axis indicates the time (in millisecond units), and the vertical axis indicates sound pressure level. FIG. 11(*c*) shows the frequency characteristic of time response, the horizontal axis indicates frequency (in Hz units), and the vertical axis indicates sound pressure level.

Thus, according to the hearing aid according to the embodiment, for example, if a sound produced as the hearing aid wearer flicks the tip of his or her nail against the hearing aid or a tap sound is used as an input signal, the case where the intensity of an input signal becomes equal to or more than the threshold value can be reliably detected and setting of the hearing aid (acoustic parameters of volume, operation mode, etc.,) can also be reliably changed in a noisy ordinary environment. The nail-tip flick sound is most easily detected and the nail-tip tap sound is second most easily detected. Therefore, adopting the nail-tip flick sound as a contact sound is most preferred and adopting the nail-tip tap sound as a contact sound is second most preferred.

Second Embodiment

Figure 3:
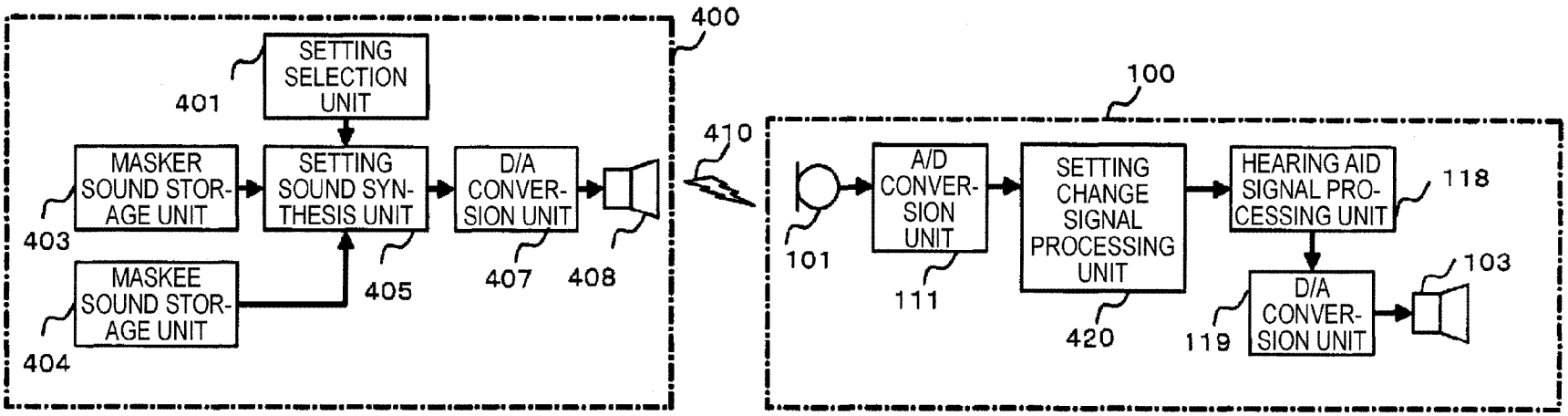
FIG. 3 is a block diagram to show an example of the schematic configuration of a hearing aid system according to a second embodiment of the invention.

FIG. 3 is a block diagram to shown an example of the schematic configuration of a hearing aid system according to a second embodiment of the invention. The hearing aid system of the embodiment is made up of a hearing aid setting device 400 and a hearing aid 100. The hearing aid setting device 400 includes a setting selection unit 401 to which predetermined setting of the hearing aid is input, a masker sound storage unit 403 for storing a masker sound (masking sound), a maskee sound storage unit 404 for storing a maskee sound (masked sound), a setting sound synthesis unit 405 for synthesizing a setting sound from the masker sound and the maskee sound based on the hearing aid setting, a D/A conversion unit 407 for converting the setting sound into an analog signal, and a speaker 408 for outputting the setting sound. Components identical with those of the hearing aid according to the first embodiment are denoted by the same reference numerals and will not be discussed again or will be simplified.

Masking refers to a phenomenon in which one sound is hard to hear in the presence of another sound as a telephone call is made in a place where noise is strong, for example. In this case, the masking sound (maker sound) is kept at a given sense level, the level of the masked sound (maskee sound) is gradually raised from a state in which it is not heard, the level at which the sound starts to be heard, namely, the minimum audible value of the maskee sound when the masker sound exists is found, and deviation from the minimum audible value when no masker sound exists is represented as dB and is adopted as the masking level.

For example, if the setting device is a mobile telephone, the masker sound may be a ringtone. The maskee sound is an adjustment sound output, for example, when setting of the hearing aid is changed and is a conventional setting sound like "pipipi," for example. The maskee sound is set to the masking level or less of the masker sound, whereby the hearing aid wearer does not feel unpleasant at the setting time of the hearing aid. The masker sound may be able to be set appropriately in response to the liking of the hearing aid wearer.

To extract the maskee sound from the masker sound, it is desirable that the frequency component contained in the maskee sound is not contained in the masker sound. The reason is as follows: Considering that hearing aid setting operation is performed according to a command of the hearing aid wearer, since the distance between the hearing aid setting device and the hearing aid is not necessarily constant, if played sound of the hearing aid setting device is constant, it is considered that the sound pressure level of the input sound of the hearing aid fluctuates. In this case, if the same frequency component is contained, it becomes difficult to extract the maskee sound from the masker sound.

A specific example of the setting sound is a sound containing a ringtone and a conventional setting sound if the setting device is a mobile telephone, for example. If the setting device is a mobile telephone, a mode is also considered wherein a setting sound provided by combining the maskee sound and the masker sound is previously downloaded from a server to the mobile telephone and is played in the mobile telephone and setting of the hearing aid is changed.

When hearing aid setting is input from the setting selection unit 401, the setting sound synthesis unit 405 combines the maskee sound stored in the maskee sound storage unit 404 and the masker sound stored in the masker sound storage unit 403 in response to the hearing aid setting supplied from the setting selection unit 401 to generate an output signal output from the speaker 408 as setting sound.

The masker sound and the maskee sound are previously generated by a sound source generator that can adjust and output a frequency and sound pressure level to change setting of the hearing aid 100.

When the sound source generator generates the masker sound, it is desirable that a sound source in which the masker sound does not contain the frequency component contained in the maskee sound, namely, a sound source containing any other frequency component than the frequency component contained in the maskee sound should be selected. When the sound source generator generates the masker sound, a non-dissonant sound, for example, music, etc., is selected, whereby the displeasure sense of the hearing aid wearer can be decreased. The masker sound thus generated is stored in the masker sound storage unit 403.

When the sound source generator generates the maskee sound, it is considered that the sound has a single frequency component or has a plurality of frequency components. If the maskee sound is a single frequency component, the computation amount of signal processing can be lightened. On the other hand, if the maskee sound is a plurality of frequency components, there is a possibility that the setting sound can be shortened. The maskee sound thus generated is stored in the maskee sound storage unit 404.

On the other hand, the hearing aid 100 includes a microphone 101 for collecting a setting sound 410, an A/D conversion unit 111 for converting the setting sound 410 into a digital signal, a setting change signal processing unit 420 for extracting hearing aid setting from the setting sound, a hearing aid signal processing unit 118 for adjusting the frequency characteristic, etc., of a sound signal, a D/A conversion unit 119 for converting a digital signal into an analog signal, and a receiver 103 for playing an output sound from an output signal of the provided analog signal.

The microphone 101 detects the setting sound 410 output from the speaker 408 and the A/D conversion unit converts the setting sound 410 into a digital signal (setting signal). The setting change signal processing unit 420 extracts a maskee sound from the setting signal and further extracts hearing aid setting from the maskee sound and changes setting of the hearing aid. In this case, the maskee sound can be set to the masking level or less of a masker sound. This means that the signal intensity of the signal indicating the masker sound can made smaller than the signal intensity of the signal indicating the masker sound. The maskee sound can be made a pure sound (sound of single frequency). The maskee sound is made a pure sound, whereby the information amount of the signal lessens and the processing load is lightened.

Figure 4:
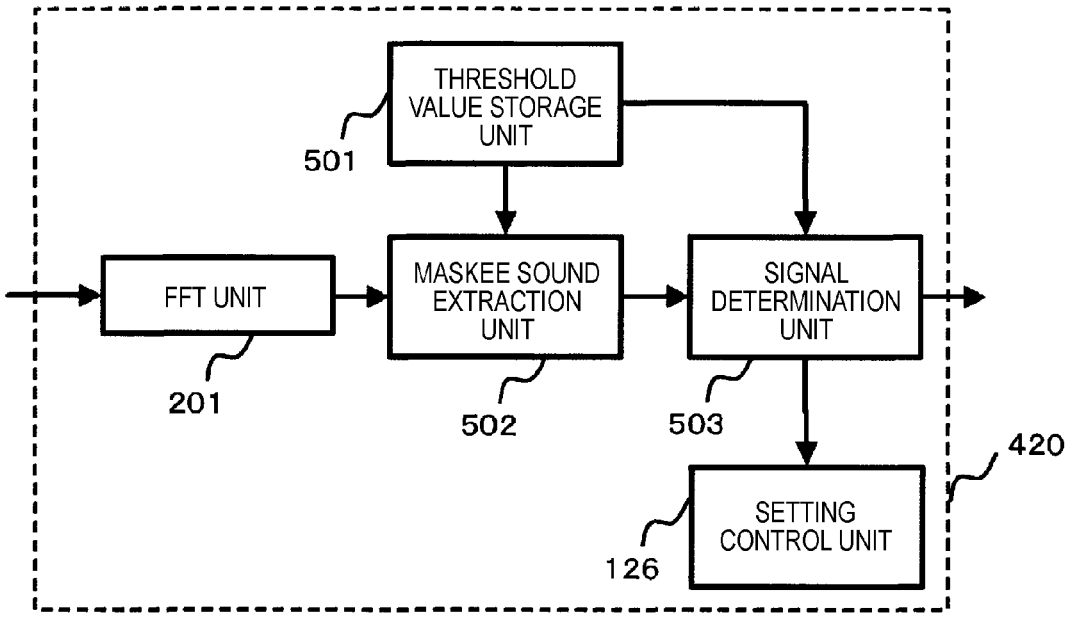
FIG. 4 is a block diagram to show an example of the internal configuration of a setting change signal processing unit in a hearing aid in the second embodiment of the invention.

FIG. 4 is a schematic drawing to show the internal configuration of a setting change signal processing unit 420. The setting change signal processing unit 420 has an FFT unit 201 for executing fast Fourier transform of an input signal, thereby converting the signal into data in a frequency domain, a threshold value storage unit 501 for storing a predetermined threshold value to be compared with the signal intensity of an input signal, a maskee sound extraction unit 502 for extracting a maskee sound from a setting sound as the input signal, a signal determination unit 503 for extracting hearing aid setting from the extracted maskee sound and a predetermined threshold value, and a setting control unit 126 for changing setting based on the extracted hearing aid setting.

Like the setting device 400, the hearing aid 100 stores the maskee sound or the features of the maskee sound (for example, frequency component, frequency signal level, and the like) and the maskee sound extraction unit 502 extracts the maskee sound from the setting sound based on the storage contents. The maskee sound extraction unit 502 pays attention to the features of the maskee sound (for example, frequency component) from a signal for each frequency component output by the FFT unit 201 and generates information as to whether or not the maskee sound is contained. Limitation that the frequency component contained in the maskee sound is not contained is added to the masker sound, whereby the maskee sound can be extracted.

The signal determination unit 503 calculates setting change for the hearing aid based on the extracted maskee sound. If the maskee sound is a pure sound, a predetermined threshold value is set for the frequency band corresponding to the maskee sound on a frequency axis and if the predetermined threshold value is exceeded at least twice or more on a time axis, setting change of the hearing aid is determined. Exceeding the threshold value at least twice or more is set for the purpose of preventing malfunction.

It is also considered that the maskee sound is a combination of pure sounds. In this case, the signal determination unit 503 sets a predetermined threshold value for the pure sounds and if all or any of the pure sounds exceeds the predetermined threshold value, setting change of the hearing aid is determined. Thus, if a plurality of pure sounds are used, processing of detecting that the predetermined threshold value is exceeded at least twice or more on the time axis for the purpose of preventing malfunction can be omitted.

Thus, according to the hearing aid system of the embodiment, hearing aid setting is extracted from the extracted maskee sound and setting is changed based on the extracted hearing aid setting, so that a dissonant adjustment sound is not heard at the setting time and a displeasure sense is not given to the hearing aid wearer.

Third Embodiment

Purposes of a hearing aid according to a third embodiment of the invention is to decrease the number of setting change times of a hearing aid wearer and prevent setting change not intended by the hearing aid wearer. The case where, for example, when an increase or decrease in the volume of a hearing aid is set, for example, different setting cannot be made in the increase direction and the decrease direction and volume setting switches as it goes round is considered. As an example, the case where as round setting, the volume once increases and reaches the upper limit and then switches to the lower limit although the hearing aid wearer wants to decrease the volume is considered. In this case, the hearing aid wearer needs to change setting more than once and a volume increase is temporarily set as he or she does not intend it; the hearing aid wearer feels inconvenient. In contrast, a method of distinguishing the operation difference of the hearing aid wearer by the hearing aid, thereby distinguishing between volume increase and volume decrease and reflecting setting as intended by one operation will be discussed.

Figure 13:
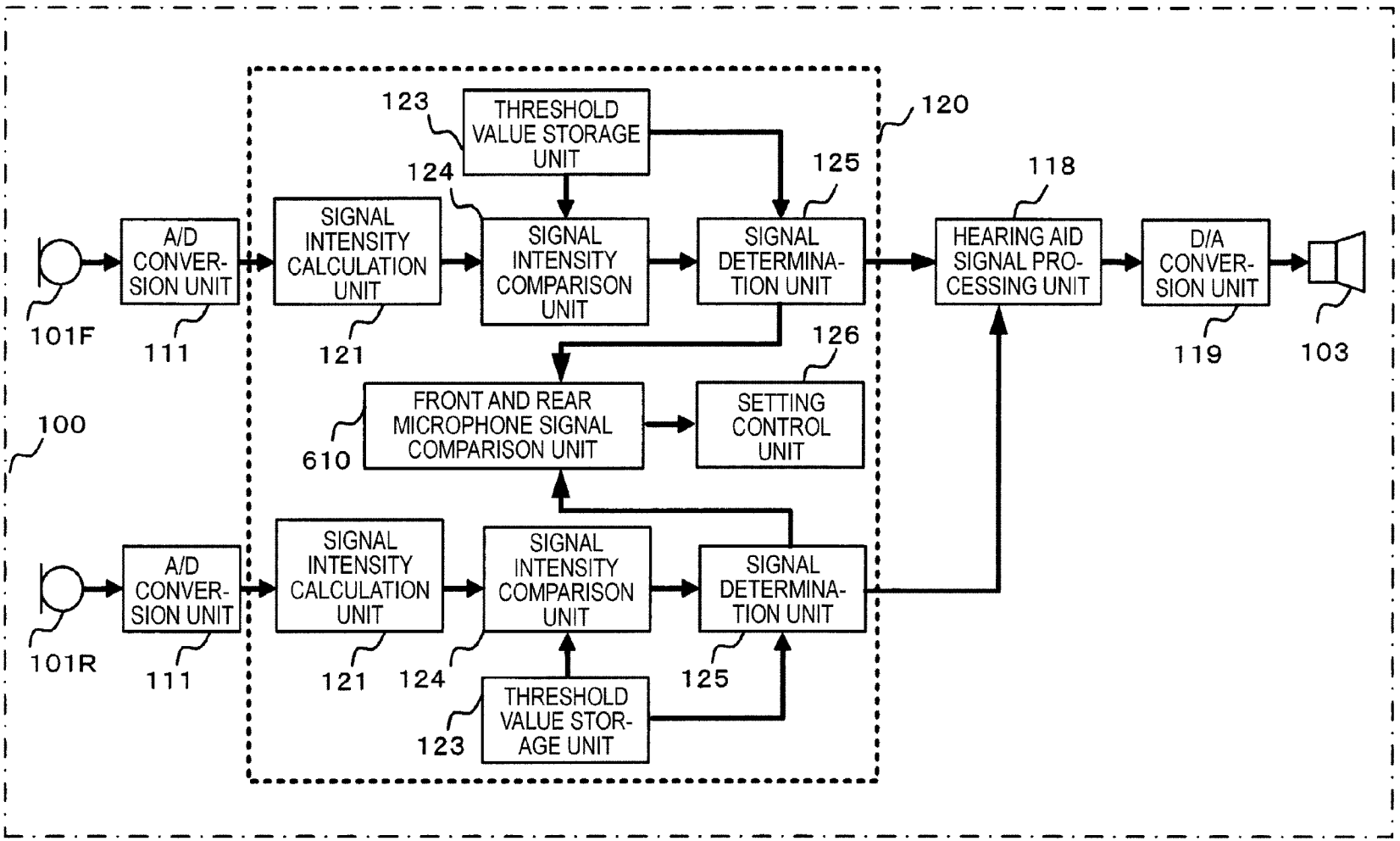
FIG. 13 is a block diagram to show an example of the schematic configuration of a hearing aid according to a third embodiment of the invention.

FIG. 13 is a block diagram to show an example of the schematic configuration of a hearing aid according to the third embodiment of the invention. The difference between the third embodiment and the first embodiment of the invention exists in that the hearing aid 100 shown in FIG. 1 includes one microphone 101; while, the hearing aid in FIG. 13 includes two microphones of a front microphone 101F and a rear microphone 101R. The configuration in which two microphones are installed in a hearing aid is generally used as the configuration for realizing a directivity synthesis function of suppressing a back sound and making a forward sound easy to hear. Parts identical with those in FIG. 1 where one microphone is installed will not be discussed again with FIG. 13 and a signal processing unit 120 different from that in FIG. 1 will be discussed. A front microphone 101F is placed on the front side in the forward direction shown in FIGS. 14 to 17 when a hearing aid 100 is worn in an ear of a hearing aid wearer, and a rear microphone 101R is placed on the back side in the forward direction shown in FIGS. 14 to 17 when the hearing aid 100 is worn in the ear of the hearing aid wearer.

The signal processing unit 120 inputs input signals from the front microphone 101F and the rear microphone 101R. In the signal processing unit 120 in FIG. 13, a signal intensity calculation unit 121, a threshold value storage unit 123, a signal intensity comparison unit 124, and a signal determination unit 125 are components for performing the same processing as those in FIG. 1. A front and rear microphone signal comparison unit 610 makes a comparison between the determination result for the input signal in the front microphone 101F and the determination result for the input signal in the rear microphone 101R. Processing of the front and rear microphone signal comparison unit 610 will be discussed with FIGS. 14 to 17. Setting distinguished by the front and rear microphone signal comparison unit 610 is reflected on a setting control unit 126.

That is, the signal processing unit 120 determines time responses of the input signal of the front microphone 101F and the input signal of the rear microphone 101R based on a contact sound generated when the hearing aid 100 is contacted in a predetermined time period. The signal processing unit 120 distinguishes a plurality of settings of the hearing aid 100 and changes the setting based on the determined time responses. The plurality of settings may be change setting in the increase direction of the volume and change setting in the decrease direction of the volume, for example.

Figure 14:
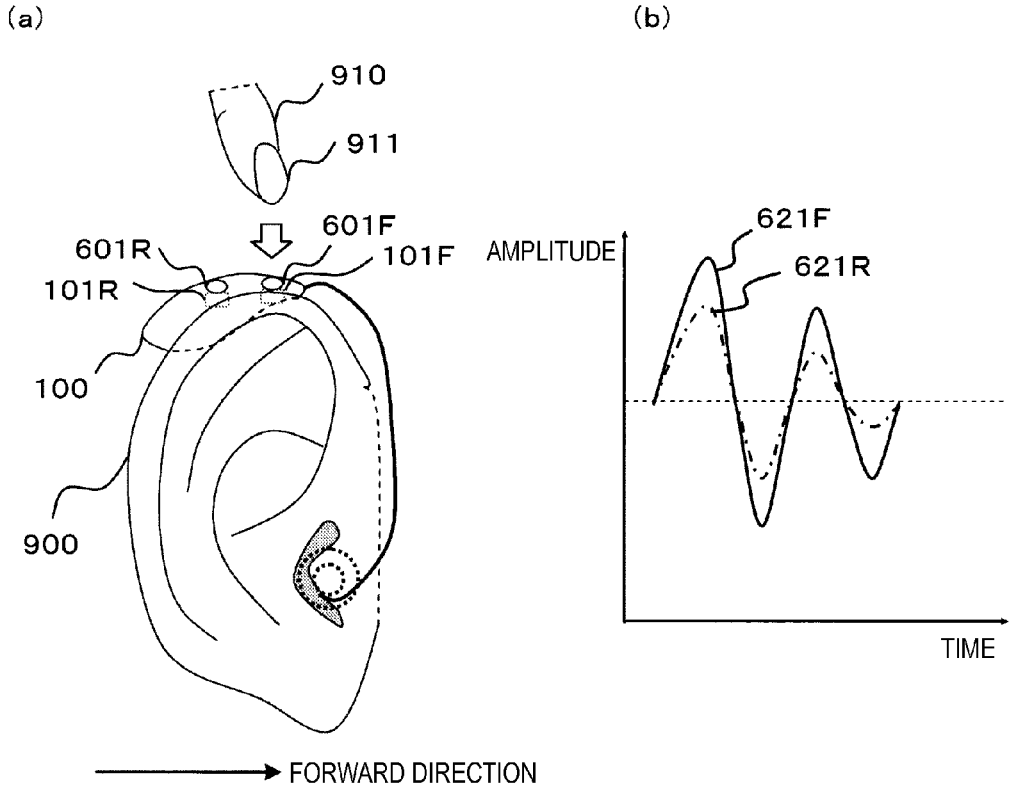
FIG. 14(*a*) is a drawing to show operation when a hearing aid wearer taps the vicinity of a front sound hole with a tip of nail thereof, and FIG. 14(*b*) is a drawing to show an example of a time response in the third embodiment of the invention.
Figure 15:
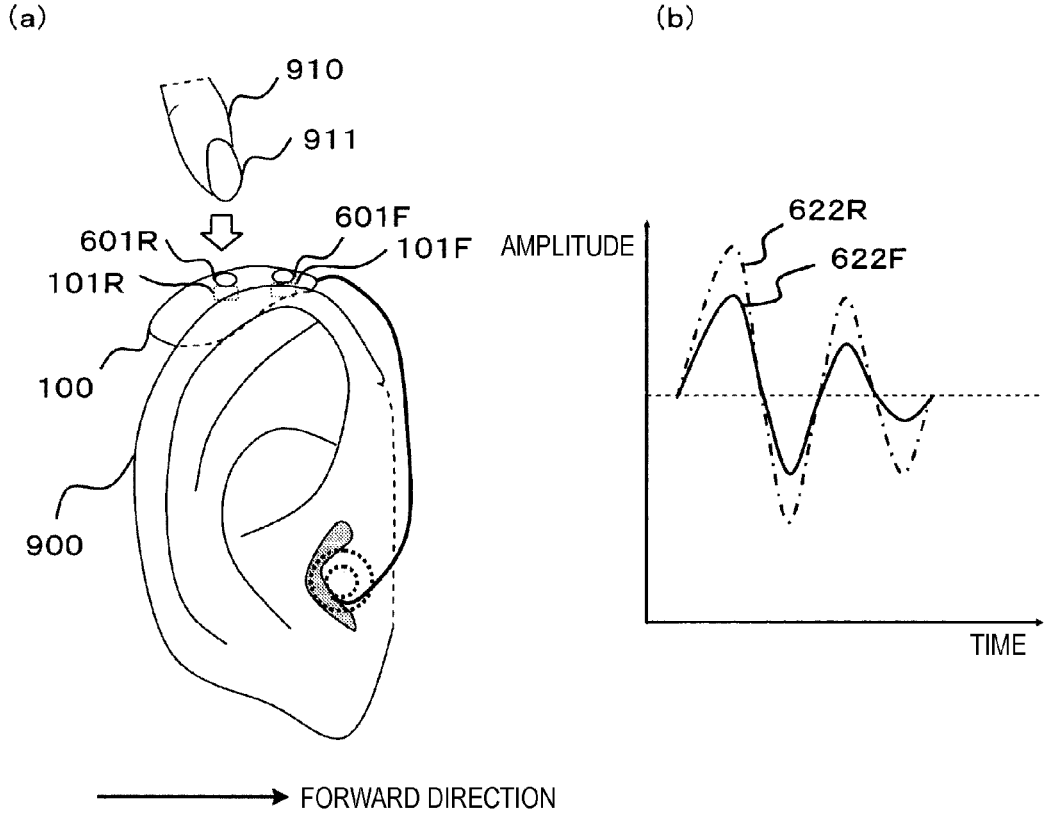
FIG. 15(*a*) is a drawing to show operation when a hearing aid wearer taps the vicinity of a rear sound hole with a tip of nail thereof, and FIG. 15(*b*) is a drawing to show an example of a time response in the third embodiment of the invention.
Figure 16:
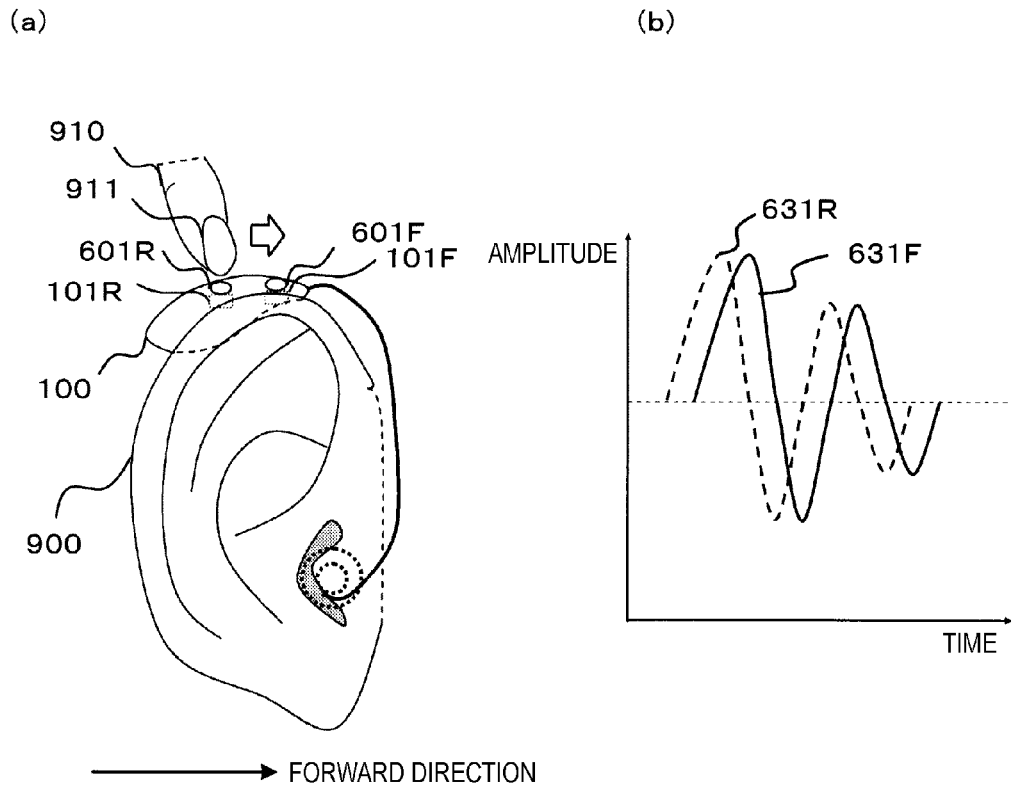
FIG. 16(*a*) is a drawing to show operation when a hearing aid wearer scrubs the hearing aid in a direction from the rear sound hole to the front sound hole with a tip of nail thereof, and FIG. 16(*b*) is a drawing to show an example of a time response in the third embodiment of the invention.
Figure 17:
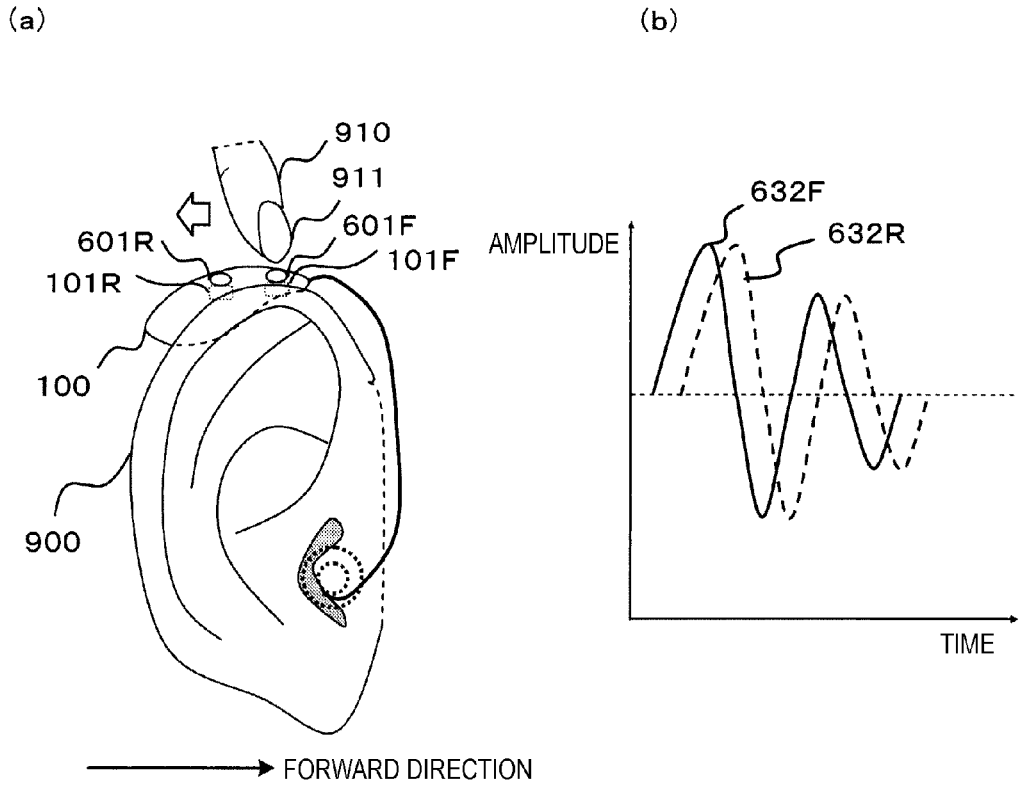
FIG. 17(*a*) is a drawing to show operation when a hearing aid wearer scrubs the hearing aid in a direction from the front sound hole to the rear sound hole with a tip of nail thereof, and FIG. 17(*b*) is a drawing to show an example of a time response in the third embodiment of the invention.

FIGS. 14 to 17 are made up of FIGS. 14(*a*) to 17(*a*) to show operation of the behind-the-ear hearing aid 100 installing two microphones by the hearing aid wearer and FIGS. 14(*b*) to 17(*b*) to show examples of time responses of input signals from the front microphone 101F and the rear microphone 101R of the hearing aid 100. FIGS. 14 and 15 represent the case where the hearing aid wearer taps the vicinity of the microphone 101 of the hearing aid 100 with the tip of nail of a finger or flicks the tip of nail of a finger against the vicinity of the microphone 101 of the hearing aid 100 as operation for changing setting. FIGS. 16 and 17 represent the case where the hearing aid wearer scrubs or strokes the vicinity of the microphone 101 of the hearing aid with the tip of nail of a finger or a finger pulp as operation for changing setting. In FIGS. 14 to 17, the behind-the-ear hearing aid is described and the embodiment can also be applied to canal type, concha type, CIC type, etc., of in-the-ear hearing aids.

FIG. 14 assumes the case where the hearing aid wearer taps the vicinity of the front microphone 101F of the hearing aid 100 with a tip of nail of a finger 911 or flicks the tip of nail of the finger 911 against the vicinity of the front microphone 101F of the hearing aid 100 to change setting. FIG. 14(*a*) is a drawing to show the operation and FIG. 14(*b*) is a drawing to show time response in the case.

FIG. 14(*a*) shows that the behind-the-ear hearing aid 100 is worn in a pinna 900 of the hearing aid wearer and setting change operation is performed with a finger 910. Two microphones are installed in the hearing aid 100 and the front microphone 101F and the rear microphone 101R exist. To input a sound into each microphone, the front microphone 101F has a front sound hole 601F and the rear microphone 101R has a rear sound hole 601R.

FIG. 14(*b*) shows a time response 621F of an input signal of the front microphone 101F and a time response 621R of an input signal of the rear microphone 101R when the hearing aid wearer taps the vicinity of the front microphone 101F of the hearing aid 100 with the tip of nail of the finger 911 or flicks the tip of nail of the finger 911 against the vicinity of the front microphone 101F of the hearing aid 100. The time response 621F has a larger amplitude than the time response 621R. Accordingly, the hearing aid 100 distinguishes the hearing aid wearer contacting the vicinity of the front microphone 101F.

FIG. 15 assumes the case where the hearing aid wearer taps the vicinity of the rear microphone 101R of the hearing aid 100 with the tip of nail of the finger 911 or flicks the tip of nail of the finger 911 against the vicinity of the rear microphone 101R of the hearing aid 100 to change setting. FIG. 15(*a*) is a drawing to show the operation and FIG. 15(*b*) is a drawing to show time response in the case.

FIG. 15(*a*) differs from FIG. 14(*a*) in that the hearing aid wearer taps the vicinity of the rear microphone 101R of the hearing aid 100 with the tip of nail or flicks the tip of nail against the vicinity of the rear microphone 101R to change setting of the hearing aid 100.

FIG. 15(*b*) shows a time response 622F of an input signal of the front microphone 101F and a time response 622R of an input signal of the rear microphone 101R when the hearing aid wearer taps the vicinity of the rear microphone 101R of the hearing aid 100 with the tip of nail of the finger 911 or flicks the tip of nail of the finger 911 against the vicinity of the rear microphone 101R of the hearing aid 100. The time response 622R has a larger amplitude than the time response 622F. Accordingly, the hearing aid 100 distinguishes the hearing aid wearer contacting the vicinity of the rear microphone 101R.

As described above with reference to FIGS. 14 and 15, the place where the hearing aid wearer taps the hearing aid 100 with the tip of nail or flicks the tip of nail against the hearing aid 100 is changed, whereby the front and rear microphone signal comparison unit 610 of the hearing aid 100 can distinguish operation of the hearing aid wearer. At this time, the front and rear microphone signal comparison unit 610 makes a comparison between the amplitude values of the input signals shown in the time response 621F and the time response 621R, and the setting control unit 126 distinguishes a plurality of settings of the hearing aid and changes the setting based on the amplitudes. Accordingly, the hearing aid 100 can distinguish the intention of the hearing aid wearer, the hearing aid wearer does not feel unpleasant, and it is made possible to change setting as intended.

FIG. 16 assumes the case where the hearing aid wearer scrubs or strokes the hearing aid 100 in a direction from the rear microphone 101R to the front microphone 101F with the tip of nail of the finger 911 to change setting. FIG. 16(*a*) is a drawing to show the operation and FIG. 16(*b*) is a drawing to show time response in the case.

FIG. 16(*a*) differs from FIG. 14(*a*) in that the hearing aid wearer scrubs or strokes the hearing aid 100 in the direction from the rear microphone 101F to the front microphone 101F with the tip of nail of the finger 911 to change setting of the hearing aid 100, for example. That is, the operation is operation of contacting the hearing aid 100 with the tip of nail of the finger 911 and moving the finger in the arrow direction shown in FIG. 16(*a*).

FIG. 16(*b*) shows a time response 631F of an input signal of the front microphone 101F and a time response 631R of an input signal of the rear microphone 101R when the hearing aid wearer scrubs or strokes the hearing aid 100 in the direction from the rear microphone 101R to the front microphone 101F of the hearing aid 100 with the tip of nail of the finger 911. It is understood that the peak portion of the amplitude of the time response 631F appears earlier on a time axis than that of the time response 631F. Accordingly, the hearing aid 100 can distinguish operation of scrubbing or stroking the hearing aid 100 from the rear to the front by the hearing aid wearer.

FIG. 17 assumes the case where the hearing aid wearer scrubs or strokes the hearing aid 100 in a direction from the front microphone 101F to the rear microphone 101R with the tip of nail of the finger 911 to change setting. FIG. 17(*a*) is a drawing to show the operation and FIG. 17(*b*) is a drawing to show time response in the case.

FIG. 17(*a*) differs from FIG. 16(*a*) in that the hearing aid wearer scrubs or strokes the hearing aid 100 in the direction from the front microphone 101F to the rear microphone 101F with the tip of nail of the finger 911 to change setting of the hearing aid 100, for example. That is, the operation is operation of contacting the hearing aid 100 with the tip of nail of the finger 911 and moving the finger in the arrow direction shown in FIG. 17(*a*).

FIG. 17(*b*) shows a time response 632F of an input signal of the front microphone 101F and a time response 632R of an input signal of the rear microphone 101R when the hearing aid wearer scrubs or strokes the hearing aid 100 in the direction from the front microphone 101F to the rear microphone 101R of the hearing aid 100 with the tip of nail of the finger 911. It is understood that the peak portion of the amplitude of the time response 632F appears earlier on a time axis than that of the time response 632F. Accordingly, the hearing aid 100 can distinguish operation of scrubbing or stroking the hearing aid 100 from the front to the rear by the hearing aid wearer.

That is, as described with reference to FIGS. 16 and 17, the front and rear microphone signal comparison unit 610 of the hearing aid 100 can distinguish operation of scrubbing or stroking the hearing aid 100 in the direction from the rear microphone 101R to the front microphone 101F or in the direction from the front microphone 101F to the rear microphone 101R with the tip of nail of the hearing aid wearer. At this time, the front and rear microphone signal comparison unit 610 determines the time difference between the amplitude peak time points of input signals indicated in the time response 621F and the time response 621R, and the setting control unit 126 distinguishes a plurality of settings of the hearing aid and changes the setting based on the time difference between the amplitude peak time points. Accordingly, the hearing aid 100 can distinguish the intention of the hearing aid wearer, the hearing aid wearer does not feel unpleasant, and it is made possible to change setting as intended.

Further, in a hearing aid having a mechanical switch for enabling the user to set volume with the single unit of the hearing aid, a variable volume change switch shaped like a disk may be used as volume setting means, and operation of the switch and operation of scrubbing or stroking the hearing aid of the embodiment resemble each other. Thus, operation of scrubbing or stroking is performed as operation of increasing or decreasing the volume, whereby erroneous operation of setting the volume by the hearing aid wearer can be easily decreased.

While the invention has been described in detail with reference to the specific embodiments, it will be obvious to those skilled in the art that various changes and modifications can be made without departing from the spirit and the scope of the invention.

This application is based on Japanese Patent Application No. 2008-212050 filed on Aug. 20, 2008, which is incorporated herein by reference.

INDUSTRIAL APPLICABILITY

The invention is useful as a hearing aid, a hearing system, etc., for preventing the user from feeling his or her displeasure caused by changing setting of the hearing aid and further enabling the user to easily change the setting.

DESCRIPTION OF REFERENCE SKINS

4 Electroacoustic transducer
5 Control signal generation unit
6 Call detection unit
10 Telephone
40, 100 Hearing aid
41 Sound wave reception unit
43 Reception switch unit
44 Power amplification unit
46 Analysis control unit
101 Microphone
101F Front microphone
101R Rear microphone
103 Receiver
111 A/D conversion unit
118 Hearing aid signal processing unit
119 D/A conversion unit
120 Signal processing unit
121 Signal intensity calculation unit
123 Threshold value storage unit
124 Signal intensity comparison unit
125 Signal determination unit
126 Setting control unit
201 FFT unit
202 Spectrum comparison unit
400 Hearing aid setting device
401 Setting selection unit
403 Masker sound storage unit
404 Maskee sound storage unit
405 Setting sound synthesis unit
407 D/A conversion unit
408 Speaker
410 Setting sound
420 Setting change signal processing unit
501 Threshold value storage unit
502 Maskee sound extraction unit
503 Signal determination unit
601F Front sound hole
601R Rear sound hole
610 Front and rear microphone signal comparison unit
621F Input signal from front microphone when front sound hole vicinity is tapped with tip of nail
621R Input signal from rear microphone when front sound hole vicinity is tapped with tip of nail
622F Input signal from front microphone when rear sound hole vicinity is tapped with tip of nail
622R Input signal from rear microphone when rear sound hole vicinity is tapped with tip of nail
631F Input signal from front microphone when hearing aid is scrubbed in direction from rear sound hole to front sound hole with tip of nail
631R Input signal from rear microphone when hearing aid is scrubbed in direction from rear sound hole to front sound hole with tip of nail
632F Input signal from front microphone when hearing aid is scrubbed in direction from front sound hole to rear sound hole with tip of nail
632R Input signal from rear microphone when hearing aid is scrubbed in direction from front sound hole to rear sound hole with tip of nail
900 Pinna
910 Finger
911 Tip of nail of finger

The invention claimed is:

1. A hearing aid comprising:

a microphone configured to generate an input signal from an input sound;

a signal processing unit configured to generate an output signal from the input signal; and a receiver configured to play an output sound from the output signal, wherein the signal processing unit determines a time response of the input signal based on a contact sound generated when the hearing aid is contacted in a predetermined time period, and changes setting of the hearing aid based on the time response, wherein the signal processing unit calculates an intensity of the input signal, and changes the setting of the hearing aid when the signal processing unit detects at least two time points, each at which an average value of the intensity of the input signal in the predetermined time period becomes equal to or less than a first predetermined threshold value and also at which the intensity of the input signal in the predetermined time period becomes equal to or more than a second predetermined threshold value.

2. The hearing aid according to claim 1, wherein the signal processing unit sets a time width for detecting the time point at which the intensity of the input signal becomes equal to or more than the second predetermined threshold value.

3. The hearing aid according to claim 2, wherein the contact sound is a flick sound or tap sound by a tip of a nail, and wherein the signal processing unit sets the time width to 20 msec or less.

4. The hearing aid according to claim 2, wherein the signal processing unit decreases a signal intensity for the time width in which the time point at which the intensity of the input signal becomes equal to or more than the second predetermined threshold value is detected.

5. The hearing aid according to claim 1, wherein the signal processing unit indicates that the setting of the hearing aid has been changed.

6. A hearing aid system comprising the hearing aid according to claim 1 and a hearing aid setting device configured to change setting of the hearing aid, wherein the hearing aid setting device comprises:

an input unit configured to input setting of the hearing aid;

a storage unit configured to store information of a maskee sound indicating an adjustment sound output at a change of setting of the hearing aid and a masker sound for masking the maskee sound;

a signal synthesis unit configured to generate an output signal based on the masker sound and the maskee sound stored in the storage unit and the setting of the hearing aid input through the input unit; and a speaker configured to play a setting sound from the output signal.

7. The hearing aid system according to claim 6, wherein a signal intensity of a signal indicating the maskee sound is equal to or less than a signal intensity of a signal indicating the masker sound.

8. The hearing aid system according to claim 6, wherein the maskee sound is a pure sound.

9. The hearing aid system according to claim 6, wherein the signal processing unit of the hearing aid indicates that the setting of the hearing aid has been changed.

10. The hearing aid system according to claim 6, wherein the masker sound contains a frequency component other than the frequency component contained in the maskee sound.

11. The hearing aid according to claim 1, wherein the signal processing unit calculates an intensity of the input signal, detects a number of times an average value of the intensity of the input signal in a predetermined time period is equal to or less than a first predetermined threshold value and also the intensity of the input signal in the predetermined time period becomes equal to or more than a second predetermined threshold value, and distinguishes a plurality of settings of the hearing aid and changes the setting based on the number of times.

* * * * *